US010530053B2

(12) United States Patent
Trotta

(10) Patent No.: US 10,530,053 B2
(45) Date of Patent: Jan. 7, 2020

(54) SYSTEM AND METHOD FOR MEASURING A PLURALITY OF RF SIGNAL PATHS

(71) Applicant: Infineon Technologies AG, Neubiberg (DE)

(72) Inventor: Saverio Trotta, Munich (DE)

(73) Assignee: INFINEON TECHNOLOGIES AG, Neubiberg (DE)

( * ) Notice: Subject to any disclaimer, the term of this patent is extended or adjusted under 35 U.S.C. 154(b) by 895 days.

(21) Appl. No.: 14/994,893

(22) Filed: Jan. 13, 2016

(65) Prior Publication Data

US 2017/0201019 A1 Jul. 13, 2017

(51) Int. Cl.
*H01Q 3/26* (2006.01)
*H01Q 3/28* (2006.01)
*H01Q 3/38* (2006.01)

(52) U.S. Cl.
CPC ..... *H01Q 3/267* (2013.01); *H01Q 3/2605* (2013.01); *H01Q 3/2694* (2013.01); *H01Q 3/28* (2013.01); *H01Q 3/38* (2013.01)

(58) Field of Classification Search
CPC .... H01Q 3/267; H01Q 3/2605; H01Q 3/2694; H01Q 3/28; H01Q 3/38; G01R 1/20; G01R 1/28; G01R 1/30; G01R 1/38; G01R 19/10; G01R 25/00; G01R 25/005; G01R 25/04; G01R 25/02; G01S 13/9047; G01S 13/48; G01S 13/424; G01S 7/5209; G01S 7/5205; G01S 7/52095; G01S 7/52046; G01S 7/52049; G01S 7/52003; G01S 7/40; G01S 7/4004; G01S 7/4008; G01S 7/4026; G01S 7/4034; G01S 7/4069; G01S 7/4073; G01S 7/4091; G01S 7/4097
See application file for complete search history.

(56) References Cited

U.S. PATENT DOCUMENTS

| | | | | |
|---|---|---|---|---|
| 4,075,698 | A * | 2/1978 | Lode | G01R 25/00 324/76.82 |
| 8,250,414 | B2 | 8/2012 | Rohatschek | |
| 9,346,441 | B2 | 5/2016 | Rasbornig et al. | |
| 2010/0056083 | A1 | 3/2010 | Kim et al. | |

(Continued)

FOREIGN PATENT DOCUMENTS

| | | | |
|---|---|---|---|
| CN | 101636662 | A | 1/2010 |
| CN | 102419403 | A | 4/2012 |
| KR | 100758309 | B1 | 9/2007 |

*Primary Examiner* — Bernarr E Gregory
*Assistant Examiner* — Daniel P Malley, Sr.
(74) *Attorney, Agent, or Firm* — Slater Matsil, LLP

(57) ABSTRACT

An embodiment method for signal path measurement includes providing a first signal at a common node coupled to a plurality of signal paths that each include a respective phase rotation circuit. The method also includes providing a second signal, over a first test path, to a first node coupled to a first signal path of the plurality of signal paths, providing the second signal, over a second test path, to a second node coupled to a second signal path of the plurality of signal paths, selecting a signal path from the plurality of signal paths, transmitting, over the selected signal path, one of the first signal and the second signal, and mixing the first signal with the second signal to obtain a measurement signal of the selected signal path. A difference in phase delay between the second test path and the first test path includes a first known phase delay.

17 Claims, 18 Drawing Sheets

(56) References Cited

U.S. PATENT DOCUMENTS

| | | | | |
|---|---|---|---|---|
| 2013/0044650 | A1* | 2/2013 | Barker | H04B 7/0617<br>370/278 |
| 2013/0079060 | A1* | 3/2013 | Pivit | H01Q 3/267<br>455/561 |
| 2013/0113657 | A1* | 5/2013 | Behbahani | H01Q 3/40<br>342/373 |
| 2013/0281029 | A1* | 10/2013 | Lee | H03D 7/12<br>455/73 |
| 2016/0036125 | A1* | 2/2016 | Gupta | H01Q 3/2605<br>342/369 |
| 2016/0197660 | A1* | 7/2016 | O'Keeffe | H01Q 1/246<br>370/329 |
| 2016/0254870 | A1* | 9/2016 | O'Keeffe | H01Q 21/24<br>455/67.14 |

* cited by examiner

SYSTEM AND METHOD FOR MEASURING A PLURALITY OF RF SIGNAL PATHS

TECHNICAL FIELD

The present invention relates generally to a system and method for measuring phase rotation, and, in particular embodiments, to a system and method for measuring phase rotation using signal mixing.

BACKGROUND

Phased-array transmit/receive systems are desired for many applications such as broadcasting, radar, space probe communication, weather research, optics, radio-frequency (RF) identification systems, and tactile feedback systems. These systems may also be used for gesture sensing, communications backhauling, and high-speed routing in Wireless Gigabit (WiGig) or other consumer wireless systems.

A phased array is an array of antennas in which the relative phase of each signal transmitting its respective antenna channel is set in such a way that the effective radiation pattern of the array is reinforced in a desired direction and suppressed in undesired directions. This reinforcement and suppression of the effective radiation pattern occurs due to constructive and destructive interference between the distinct phase signals emanated by each antenna. The phase relationships may be adjustable, as for beam steering. A phased array may be used to point a fixed radiation pattern, or to scan rapidly in azimuth or elevation.

One type of phased array is a dynamic phased array. In a dynamic phased array, each signal path transmitting an antenna channel incorporates an adjustable phase shifter, and these adjustable phase shifters are collectively used to move the beam with respect to the array face.

SUMMARY

In accordance with a first example embodiment of the present invention, a method for signal path measurement is provided. The method includes providing a first signal at a common node coupled to a plurality of signal paths that each include a respective phase rotation circuit. The method also includes providing a second signal, over a first test path, to a first node coupled to a first signal path of the plurality of signal paths. The method also includes providing the second signal, over a second test path, to a second node coupled to a second signal path of the plurality of signal paths, such that a difference in phase delay between the second test path and the first test path includes a first known phase delay. The method also includes selecting a signal path from the plurality of signal paths, transmitting, over the selected signal path, one of the first signal and the second signal, and mixing the first signal with the second signal to obtain a measurement signal of the selected signal path.

In accordance with a second example embodiment of the present invention, a measurement circuit is provided. The measurement circuit includes a first semiconductor device. The first semiconductor device includes a plurality of signal paths that each include a respective phase rotation circuit. The first semiconductor device also includes a first node coupled to a first signal path of the plurality of signal paths, a second node coupled to a second signal path of the plurality of signal paths, and a common node coupled to the plurality of signal paths. The first semiconductor device is configured to provide a first signal at the common node, to provide a second signal to the first node over a first test path, to provide the second signal to the second node over a second test path, to transmit, over a selected signal path of the plurality of signal paths, one of the first signal and the second signal, and to mix the first signal with the second signal to obtain a measurement signal of the selected signal path. A difference in phase delay between the second test path and the first test path includes a first known phase delay.

In accordance with a third example embodiment of the present invention, a measurement system is provided. The measurement system includes a first semiconductor device. The first semiconductor device includes a plurality of signal paths coupled to each other at a common node and a plurality of test paths that include a first test path and a second test path. The first semiconductor device also includes a reference node coupled between the first test path and a first signal path of the plurality of signal paths, a non-reference node coupled between the second test path and a second signal path of the plurality of signal paths, and a first frequency mixer that includes an input coupled to one of the reference node and the common node. The first semiconductor circuit also includes a measurement output node coupled to an output of the first frequency mixer such that a difference in phase delay between the second test path and the first test path includes a first known phase delay. Each of the plurality of signal paths includes a respective phase rotation circuit.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION OF ILLUSTRATIVE EMBODIMENTS

Figure 1A:
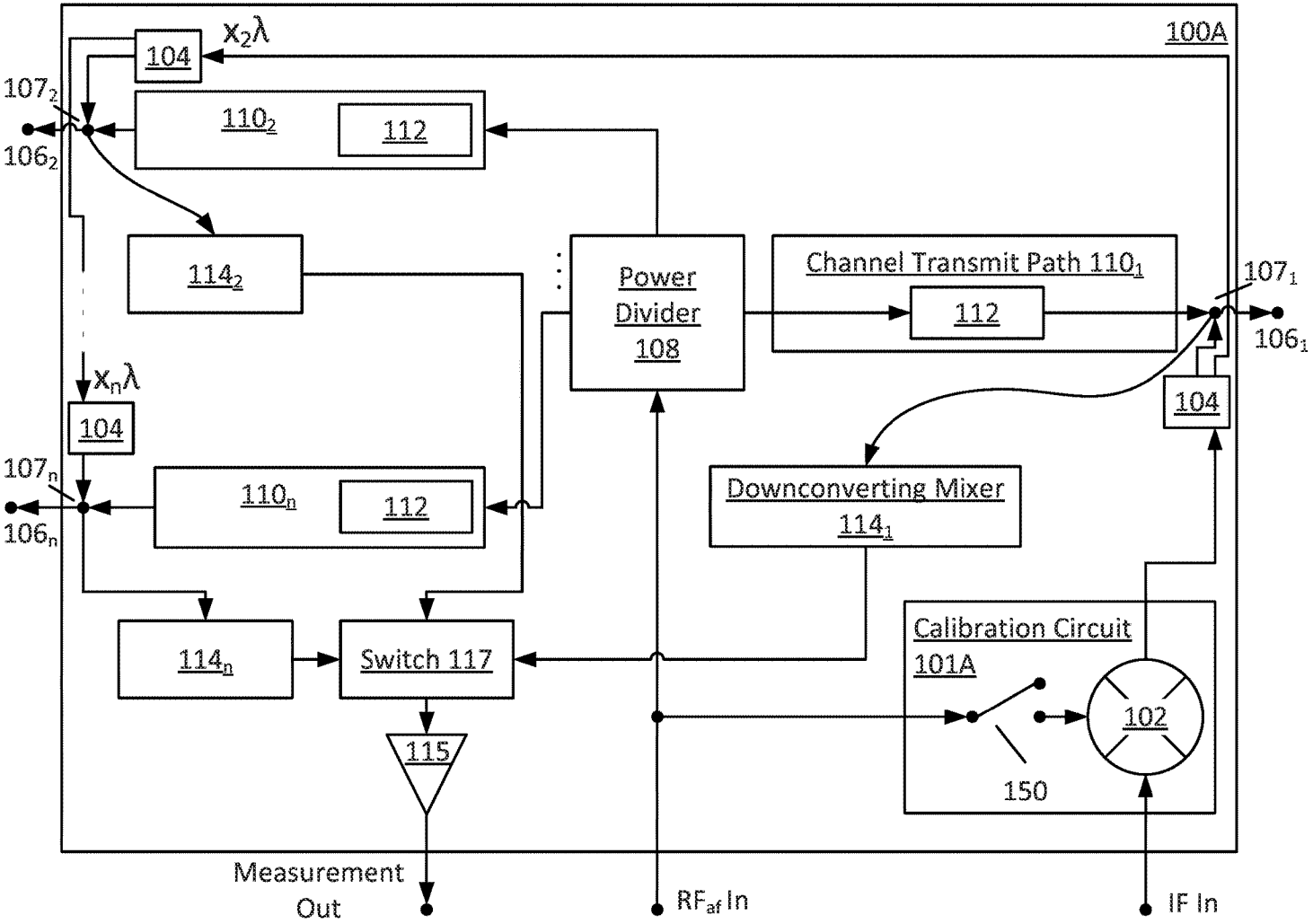
FIG. 1A is a block diagram illustrating a transmit-configured multi-channel beam-steering Integrated Circuit (IC), in accordance with example embodiments described herein.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, a system and method for measuring phase change and/or gain of a channel transmit/receive path for use by an RF transmit/receive system such as a millimeter-wave MIMO system supporting a scalable number of phased-array channels. Further embodiments may be applied to other frequency bands or to other transmitter/receiver systems that require phase or amplitude measurement to support beam-steering applications such as, for example, gesture sensing, communications backhauling, high-speed routing in WiGig or other consumer wireless systems, etc.

In various embodiments, an RF IC has multiple transmit and/or receive signal paths that are each connected to a corresponding RF interface port. For testing purposes, groups of RF interface ports are connected together in series via delay circuits that may be implemented, for example, using RF transmission lines. In some embodiments, the delays are chosen such that an RF signal of a known frequency propagates through the various delay circuits such that RF signal at each port has substantially the same relative phase. During calibration, a first RF test signal of a first frequency is introduced to this network of interface ports and delay circuits, while a second test RF signal of a second frequency is summed at a common port opposite the RF interface port. For example, in the case of a transmitter, the second RF test signal is introduced to a common input of the multiple transmit paths, and in the case of a receiver, the second RF test signal is summed at a common output of the multiple receive paths. In various embodiments, the relative phase shift of each of the multiple transmit and/or receive signal paths are determined by successively activating each of the multiple transmit and/or receive signal paths, downconverting the first and second RF test signals, and measuring the relative phases of the downconverted first and second RF test signals that correspond to the various transmit and/or receive signal paths, Based on these relative phase measurements, phase adjustment circuitry in the multiple transmit paths may be tuned to calibrate the phase shift in each one of the multiple transmit and/or receive signal paths.

In various embodiments, a beam-steering IC is a semiconductor device that is capable of phase-adjusting multiple RF signals, where during normal operation these RF signal either are to be output from IC terminals connected to phased-array transmit antennas, or have been input from terminals connected to receive antennas. The beam-steering IC also supports a calibration operation by providing a measurement signal for its internal signal path over which the RF signal is to be transmitted to or received from a set of first nodes respectively located on the IC near to each terminal. In a transmit-configured IC, each of the channel transmit paths are connected to begin at a common node on the IC and end at a respective one of the first nodes that is an output node of the channel transmit path. In a receive-configured IC, each of the channel receive paths begins at a respective one of the first nodes that is an input node of the channel receive path and ends at a common node of all the channel receive paths on the IC. The measurement signal contains phase information for a selectable one of the channel transmit or receive paths. This phase information can be used to measure the relative phase adjustment of the selected channel transmit/receive path relative to one of the channel transmit/receive paths that is used as a reference. The measurement signal may also measure the amplitude of the selected path.

In various embodiments, the measurement signal may be provided by mixing/down-converting two RF test tones with each other, one of these RF test tones having been sent through the phase rotation circuitry of the selected channel transmit/receive path. One of these RF test tones has a frequency that would be in the band of signals transmitted or received at an antenna of the phased array during normal operation, and such a test tone is referred to in this disclosure as an array-frequency signal or array-frequency test tone. The other RF test tone is an upconverted test tone having a frequency that is different from the array-frequency test tone by a frequency offset amount. This upconverted test tone may be generated by upconverting the array-frequency test tone with by mixing it with a lower frequency test tone having a frequency that is equal to the frequency offset amount. In some embodiments, the lower frequency test tone is an Intermediate Frequency (IF) test tone that is generated by an external source and provided to the beam-steering IC. The array-frequency test tone may be generated either by a Voltage Controlled Oscillator (VCO) located on the IC or provided from an external RF source. The upconverted test tone may be passively coupled to a first IC-to-channel output, and also coupled to every other IC-to-channel output via segments of transmission line having known length. If the length of the transmission line segments are known, the phase change of the upconverted test tone in propagating from one IC-to-channel output to another IC-to-channel output is known as well. This known propagation phase change may be used during the calibration operation to correct any comparison of the measurement signal of the selected channel transmit/receive path to that of any other channel transmit/receive path.

In various embodiments where channel transmit paths are measured, the channel transmit path measurement signal may be provided by sending the array-frequency test tone through the phase rotation circuitry of the selected channel transmit path and then downconverting the upconverted test tone by mixing it with the array-frequency test tone. In various embodiments where receive channel transmit paths are measured, the channel transmit path measurement signal may be provided by sending the upconverted test tone through the phase rotation circuitry of the selected channel receive path and then downconverting it by mixing it with the array-frequency test tone.

In various embodiments where multiple multi-channel beam-steering ICs are used together to build an even larger phased array, an array-frequency test tone generated by a transceiver such as, for example, a transceiver IC mounted on the same Printed Circuit Board (PCB), may be provided to each beam-steering IC along a respective transmission line having the same propagation phase change as that of the transmission line to any other of the beam-steering ICs in the array. An IF test tone generated by a modem may similarly be provided to the multiple beam-steering ICs using such signal paths having a same phase change.

In an alternative embodiment where multiple receive-configured beam-steering ICs are used together, an oscillator (e.g., a VCO) on a first IC is used for all the ICs and may be used to directly calibrate the first IC. To calibrate the remaining ICs, an over-the-air RF transmission received by the array may then be used in combination with phase sweeping of the channels of the remaining ICs.

FIG. 1A shows an embodiment of a transmit-configured multi-channel beam-steering IC. An array-frequency signal $RF_{af}$ generated externally is received by the IC 100A. The array-frequency signal is provided to a power divider 108 that may be, for example, a Wilkinson power divider. The power divider 108 splits the array-frequency signal into multiple channel signals that are provided to multiple channel transmit paths $\mathbf{110}_1$-110*n* that run from the power divider 108 to respective output nodes $\mathbf{107}_1$-$\mathbf{107}_n$ of the channel transmit paths $\mathbf{110}_1$-110*n*. Nodes $\mathbf{107}_1$-$\mathbf{107}_n$ are located near to individual IC-to-channel transmit terminals $\mathbf{106}_1$-$\mathbf{106}_n$ of the IC 100A. The channel transmit paths $\mathbf{110}_2$-$\mathbf{110}_n$ have similar structure to that of channel transmit path $\mathbf{110}_1$, but may have different phase change and amplitude attenuation characteristics. Each of the channel transmit paths $\mathbf{110}_1$-$\mathbf{110}_n$ includes an adjustable phase rotation circuit 112 that receives the channel signal and rotates its phase by an adjustable amount before providing it to the IC transmit terminals $\mathbf{106}_1$-$\mathbf{106}_n$. In some embodiments, the IC 100A has a number of transmit terminals that is a power of two such as, for example, four transmit terminals or eight transmit terminals.

Referring again to the embodiment of FIG. 1A, a calibration switch 150 switches the beam-steering IC 100A from normal operation mode to calibration mode. When the beam-steering IC 100A is in calibration mode, the externally generated array-frequency signal is also received by a calibration circuit 101A, along with an externally generated IF test tone. The calibration circuit 101A includes an upconversion mixer 102. In various embodiments, the upconversion mixer 102 may be a single sideband mixer. The upconverting mixer 102 upconverts the IF test tone by mixing it with the externally generated array-frequency signal to provide an upconverted test tone. This upconverted test tone is provided to a passive coupler 104. The passive coupler 104 may be, for example, a directional coupler. The passive coupler 104 provides the upconverted test tone to a node $\mathbf{107}_1$ that is located nearby the IC-to-channel output terminal $\mathbf{106}_1$, which provides the upconverted test tone to additional passive couplers 104 that are each respectively coupled to respective nodes $\mathbf{107}_2$-$\mathbf{107}_n$ located nearby each of the other IC-to-channel output terminals $\mathbf{106}_2$-$\mathbf{106}_n$. This transmission of the upconverted test tone to each additional output node i (=2 to n) occurs along a respective transmission line having known phase change in accordance with a known transmission length $x_i\lambda$, where $\lambda$ is the wavelength of the upconverted test tone and $x_i$ is a known constant multiple for the path to output node i. In some embodiments, $x_i$ is an integer. These transmission lines may provide, for example, a same relative phase for each of output nodes $\mathbf{107}_2$-$\mathbf{107}_n$ at a particular frequency.

A downconverting mixer $\mathbf{114}_1$ coupled to the output node $\mathbf{107}_1$ downconverts the upconverted test tone by mixing it with the phase-rotated channel signal that is output from the channel transmit path $\mathbf{110}_1$. In various embodiments, these two signals have respective frequencies of $f_1$ and $f_2$, and down-converting mixer $\mathbf{114}_1$ may be implemented using a circuit having a second order non-linearity such that the down-converting mixer $\mathbf{114}_1$ produces an output signal having a frequency $f_0$ that is the difference between the frequencies of the two signals, i.e., $f_0=f_1-f_2$. This output signal is a first measurement signal that contains information about the effect of channel transmit path $\mathbf{110}_1$ on the phase and amplitude of its channel signal. Downconverting mixers $\mathbf{114}_2$-$\mathbf{114}_n$ may also output measurement signals containing phase and amplitude information about channel transmit paths $\mathbf{110}_2$-$\mathbf{110}_n$. These measurement signals from the various channel transmit paths are received by a switch 117, which may select one of these measurement signals for output from IC 100A after amplification by operational amplifier 115. This measurement signal may be stored and then compared to the measurement signal for any of the other transmit paths of IC 100A. In some embodiments, this measurement signal is passed through an external Analog-to-Digital Converter (ADC) that is, for example, mounted on the same Printed Circuit Board (PCB) as the IC 100A or integrated into the IC 100A. The resulting digital measurement signal is then stored in a digital memory, or is digitally compared to a stored signal by an external semiconductor device such as, for example, a modem mounted on the same PCB. In some embodiments, the switch 117 may also be coupled to one or more other sensors on the IC 100A such as, for example a temperature sensor, and the switch 117 may select for output from IC 100A either a transmit path measurement signal or a sensor output signal.

Figure 1B:
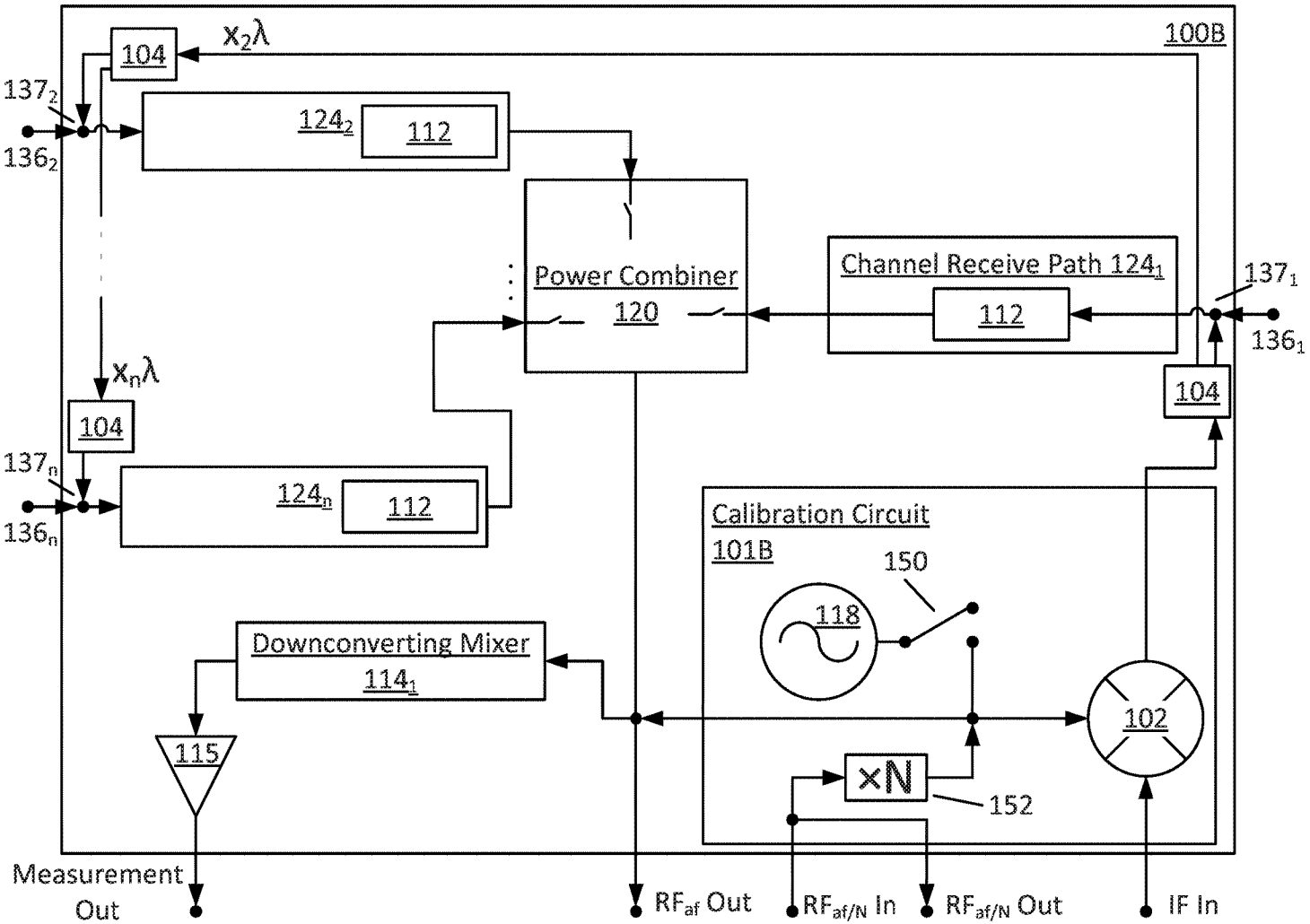
FIG. 1B is a block diagram illustrating a receive-configured multi-channel beam-steering IC, in accordance with example embodiments described herein.

FIG. 1B shows an embodiment of a receive-configured multi-channel beam-steering IC 100B. When the IC 100B is in calibration mode, an array-frequency signal $RF_{af}$ may be generated on the IC 100B by an oscillator 118 of a calibration circuit 101B. In some millimeter-wave embodiments, the array-frequency signal $RF_{af}$ may have a frequency in the range of 57-64 GHz. The calibration circuit 101B also receives an externally generated IF test tone.

IC 100B also includes an input terminal that may receive an externally generated signal to be used during calibration in lieu of a signal generated by the oscillator 118. This externally generated signal $RF_{af/N}$ has a frequency that is N times less than the array-frequency signal. For example, $RF_{af}$ may have a frequency of 60 GHz and $RF_{af/N}$ may have a frequency of 15 GHz for N equal to 4. The externally generated signal $RF_{af/N}$ is provided to a frequency multiplier 152, which increases the frequency of the externally generated signal by N times and thus generates the array-frequency signal $RF_{af}$. The externally generated signal $RF_{af/N}$ is provided to an upconverting single-side mixer 102 included in the calibration circuit 101B. The externally generated signal $RF_{af/N}$ is also fed to an output terminal so that it may be provided, for example, to additional beam-steering ICs. In some embodiments, the externally generated signal $RF_{af/N}$ is buffered or amplified before being provided to the output terminal.

The upconverting mixer 102 upconverts the IF test tone by mixing it with the array-frequency signal $RF_{af}$ to provide an upconverted test tone. This upconverted test tone is provided to a passive coupler 104. The passive coupler 104 provides the upconverted test tone to an input node $\mathbf{137}_1$ of the channel receive path $\mathbf{124}_1$, which is located between channel receive path $\mathbf{124}_1$ and a channel-to-IC receive terminal $\mathbf{136}_1$. From input node $\mathbf{137}_1$, the upconverted test tone is provided to additional passive couplers 104 along transmission lines having known phase change characteristics, where each of these additional passive couplers 104 is respectively coupled to respective input nodes $\mathbf{137}_2$-$\mathbf{137}_n$ of each of the other channel receive paths $\mathbf{124}_2$-$\mathbf{124}_n$, which are respectively located between channel receive paths $\mathbf{124}_2$-$\mathbf{124}_n$ and channel-to-IC receive terminals $\mathbf{136}_2$-$\mathbf{136}_n$. The upconverted test tone is also provided from input node $\mathbf{137}_1$ as a receive path test tone to the channel receive path $\mathbf{124}_1$.

Channel receive path $\mathbf{124}_1$ includes an adjustable phase rotation circuit 112 that receives the receive path test tone from IC-to-channel input $\mathbf{126}_1$, and rotates its phase by an adjustable amount before providing it to a power combiner 120. The channel receive paths $\mathbf{124}_2$-$\mathbf{124}_n$ have similar structure to that of channel receive path $\mathbf{124}_1$, but may have different phase change and amplitude attenuation characteristics. The selection of the channel path is made by switching on or off the selected path of channel receive paths $\mathbf{124}_1$-$\mathbf{124}_n$. Only one of these channel receive paths $\mathbf{124}_1$-$\mathbf{124}_n$ is selected for measurement at a time. For example, when the channel receive path $\mathbf{124}_1$ is selected, then receive path $\mathbf{124}_1$ is the receive path selected for measurement. The power combiner 120 provides the phase-rotated channel signal from the selected receive path to a downconverting mixer $\mathbf{114}_1$.

The downconverting mixer $\mathbf{114}_1$ also receives the array-frequency signal generated by the oscillator 118. The downconverting mixer $\mathbf{114}_1$ downconverts the phase-rotated channel signal by mixing it with the array-frequency signal to generate a measurement signal to be output from IC 100B after amplification by operational amplifier 115. This measurement signal contains information about the effect of the selected channel receive path on the phase and amplitude of its channel signal. In some embodiments, the IC 100B may also include a switch that is coupled to the output of the operational amplifier 115 and to one or more other sensors on the IC 100B such as, for example a temperature sensor, and the switch may select for output from IC 100B either the selected receive path measurement signal or a sensor output signal.

Figure 1C:
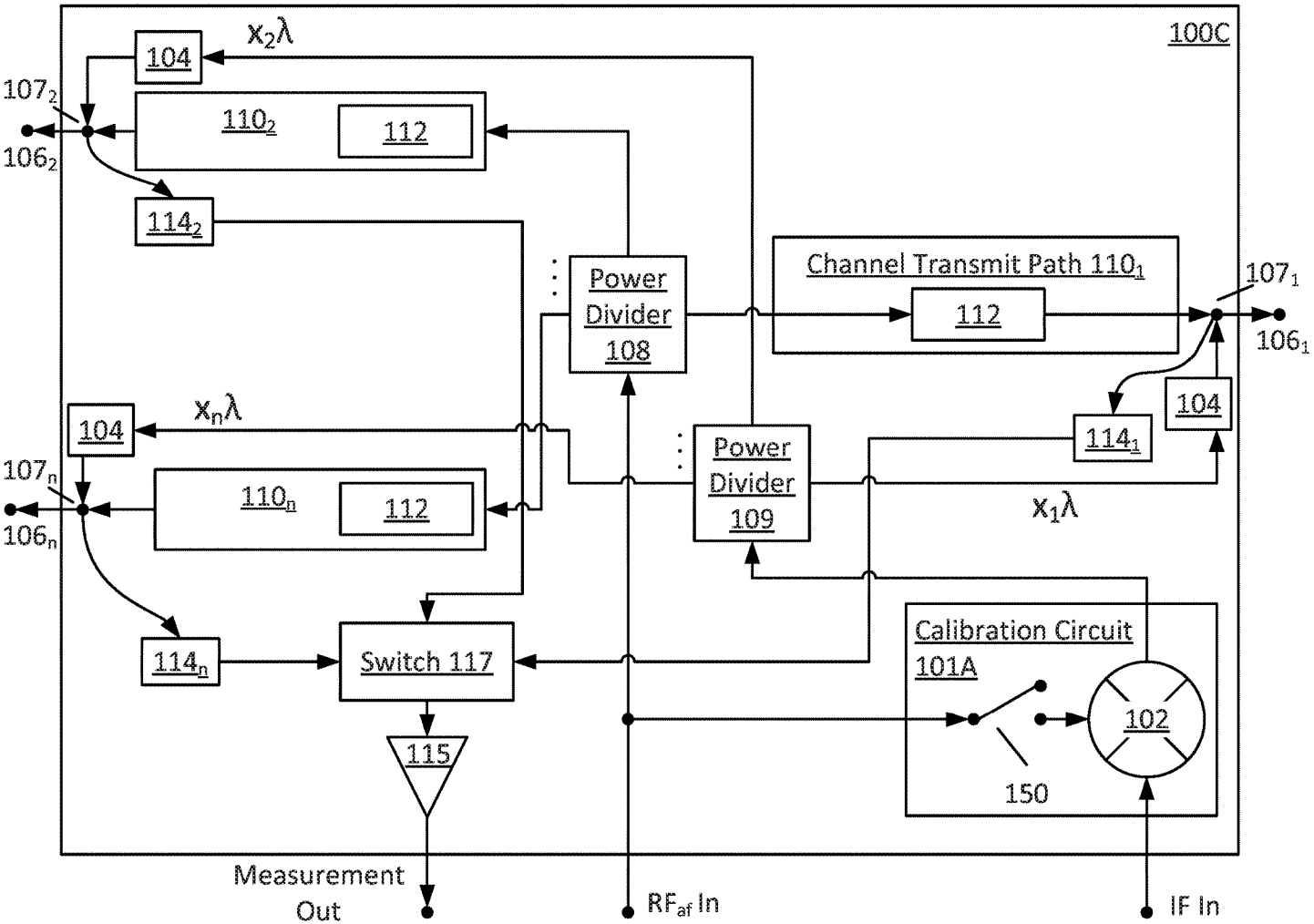
FIG. 1C is a block diagram illustrating an alternative embodiment of the IC of FIG. 1A, in accordance with example embodiments described herein.

FIG. 1C shows an alternative embodiment of the transmit-configured multi-channel beam-steering IC of FIG. 1A. The embodiment IC 100C of FIG. 1C differs from the IC 100A of FIG. 1A by including a second power divider 109 for splitting the upconverted test tone. Power divider 109 receives the upconverted test tone from calibration circuit 101A and splits it into multiple signals that are provided to the multiple passive couplers 104, which are each respectively coupled to the respective output nodes $\mathbf{107}_1$-$\mathbf{107}_n$. This transmission of the upconverted test tone to each output node i (=1 to n) occurs along a respective transmission line having known phase change in accordance with a known transmission length $x_1\lambda$, where $\lambda$ is the wavelength of the upconverted test tone and $x_1$ is a known constant multiple for the path to output node i.

Figure 1D:
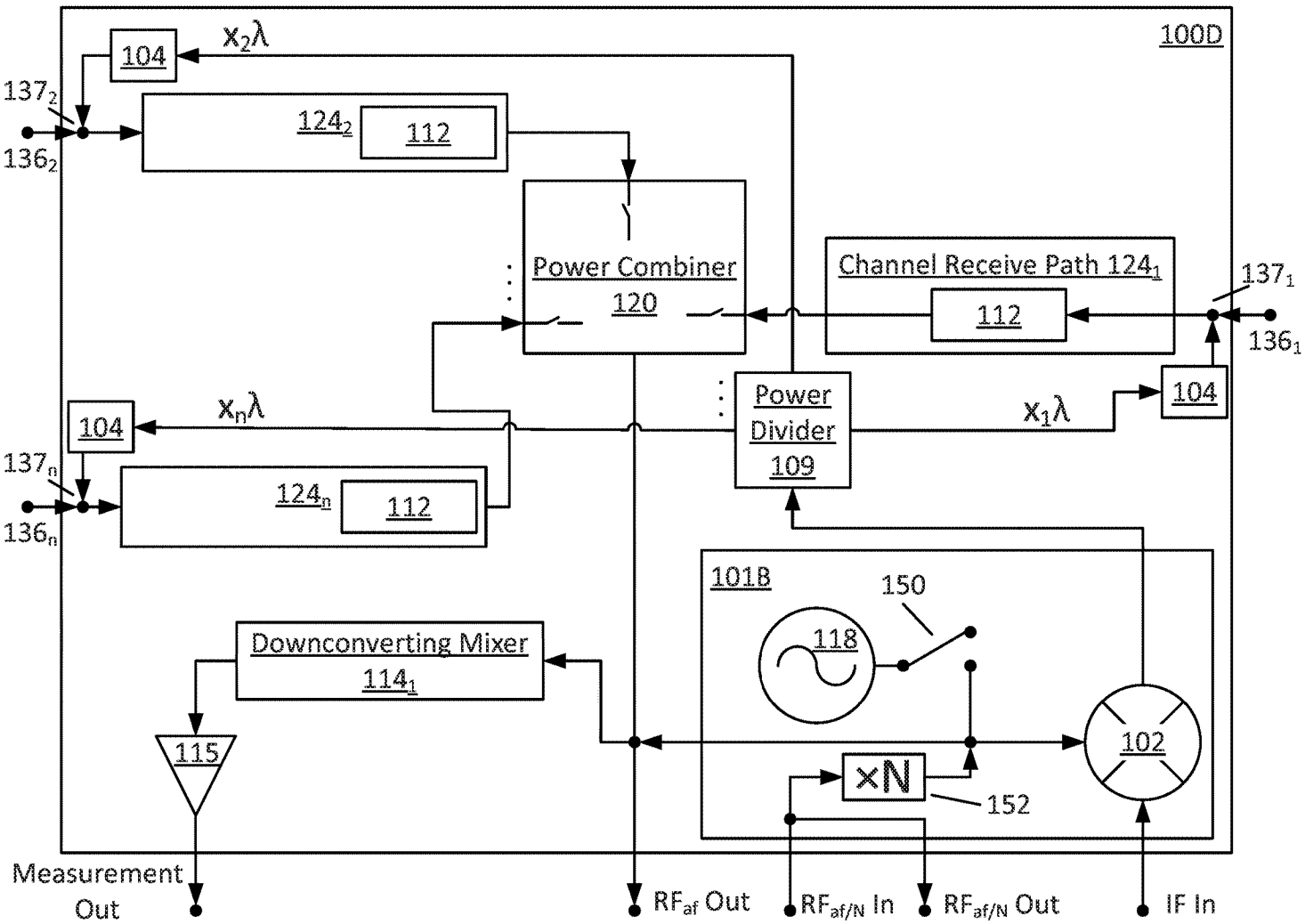
FIG. 1D is a block diagram illustrating an alternative embodiment of the IC of FIG. 1B, in accordance with example embodiments described herein.

FIG. 1D shows an alternative embodiment of the receive-configured multi-channel beam-steering IC of FIG. 1C. The embodiment IC 100D of FIG. 1D differs from the IC 100B of FIG. 1B by including a power divider 109 for splitting the upconverted test tone. Power divider 109 receives the upconverted test tone from calibration circuit 101B and splits it into multiple signals that are provided to the multiple passive couplers 104, which are each respectively coupled to the respective input nodes $\mathbf{137}_1$-$\mathbf{137}_n$. This transmission of the upconverted test tone to each input node i (=1 to n) occurs along a respective transmission line having known phase change in accordance with a known transmission length $x_1\lambda$, where $\lambda$ is the wavelength of the upconverted test tone and $x_i$ is a known constant multiple for the path to input node i.

Figure 2A:
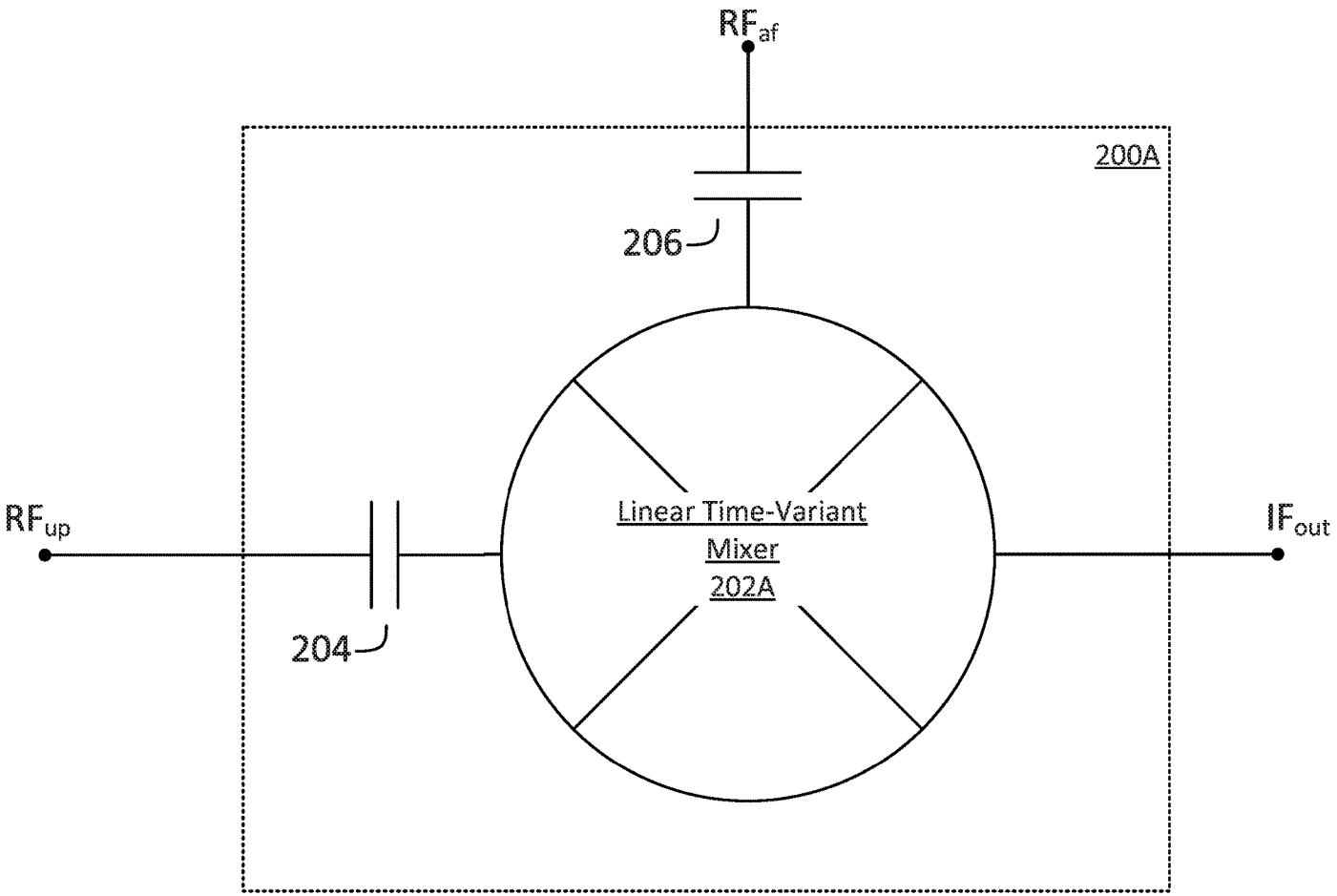
FIG. 2A is a block diagram illustrating a downconverting mixer circuit that may be used in the embodiments of FIG. 1A and FIG. 1B, in accordance with example embodiments described herein.

FIG. 2A shows an embodiment downconverting mixer circuit 200A that may be used as one of the downconverting mixers $\mathbf{114}_1$-$\mathbf{114}_n$ of FIGS. 1A to 1D. The down-converting mixer circuit 200A includes a linear time-variant mixer 202A and capacitors 204 and 206. The array-frequency signal $RF_{af}$ is an input signal of the capacitor 206, and the upconverted test tone $RF_{up}$ is an input signal of the capacitor 204. Each of the capacitors 204 and 206 capacitively couples the AC component of its respective capacitor input signal to the linear time-variant mixer 202A, which generates a downconverted signal. This downconverted signal has a linear relationship with the input signals of the linear time-variant mixer 202A so that phase information contained in either of the array-frequency signal $RF_{af}$ or the upconverted test tone $RF_{up}$ is recoverable after down-conversion. Nevertheless, in some embodiments mixer 202A is implemented using a diode.

Referring again to FIG. 2A, the downconverted signal is provided as an output signal $IF_{out}$ of the downconverting mixer circuit 200A. The frequency of this downconverted signal is the difference between the frequency of the $RF_{up}$ signal and the $RF_{af}$ signal. For example, if the $RF_{up}$ signal has a frequency of 60.01 GHz and the $RF_{af}$ signal has a frequency of 60 GHz, the downconverted signal has a frequency of 10 MHz.

Figure 2B:
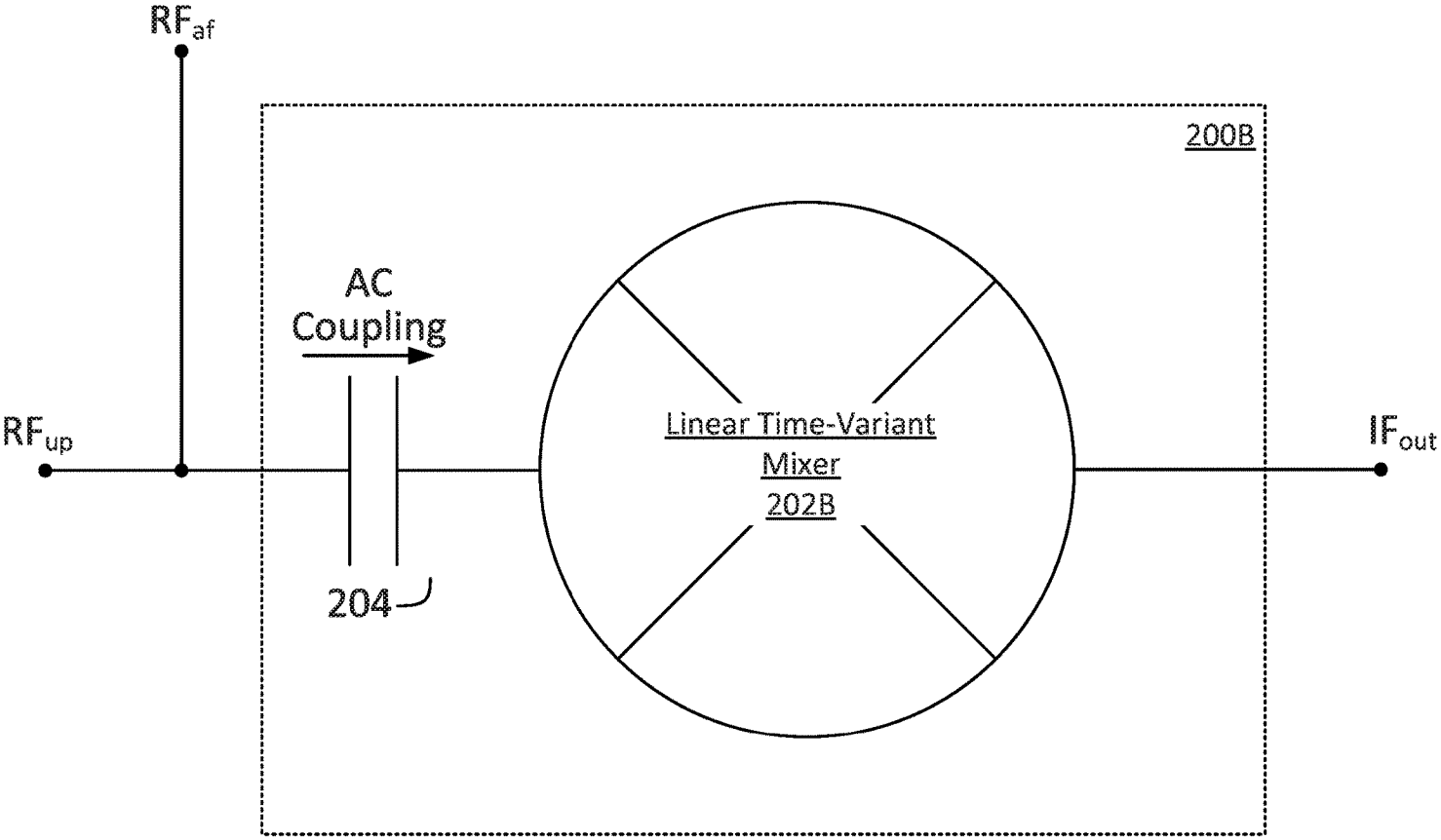
FIG. 2B is a block diagram illustrating an alternative embodiment of the downconverting mixer circuit of FIG. 2A, in accordance with example embodiments described herein.

FIG. 2B shows an alternative embodiment downconverting mixer circuit 200B that may be used as one of the downconverting mixers $\mathbf{114}_1$-$\mathbf{114}_n$ of FIGS. 1A to 1D. The downconverting mixer circuit 200B differs from the down-converting mixer circuit 200A of FIG. 1A in that it does not include capacitor 206, but instead the array-frequency signal $RF_{af}$ and the upconverted test tone $RF_{up}$ are added together at a junction terminal to form an input signal of the capacitor 204. The capacitor 204 capacitively couples the AC component of this capacitor input signal to a linear time-variant mixer 202B, which generates the downconverted signal. This downconverted signal has a linear relationship with the input signal of the linear time-variant mixer 202B so that phase information contained in either of the array-frequency signal $RF_{af}$ or the upconverted test tone $RF_{up}$ is recoverable after down-conversion. Nevertheless, in some embodiments the mixer 202B is implemented using a diode.

Figure 3A:
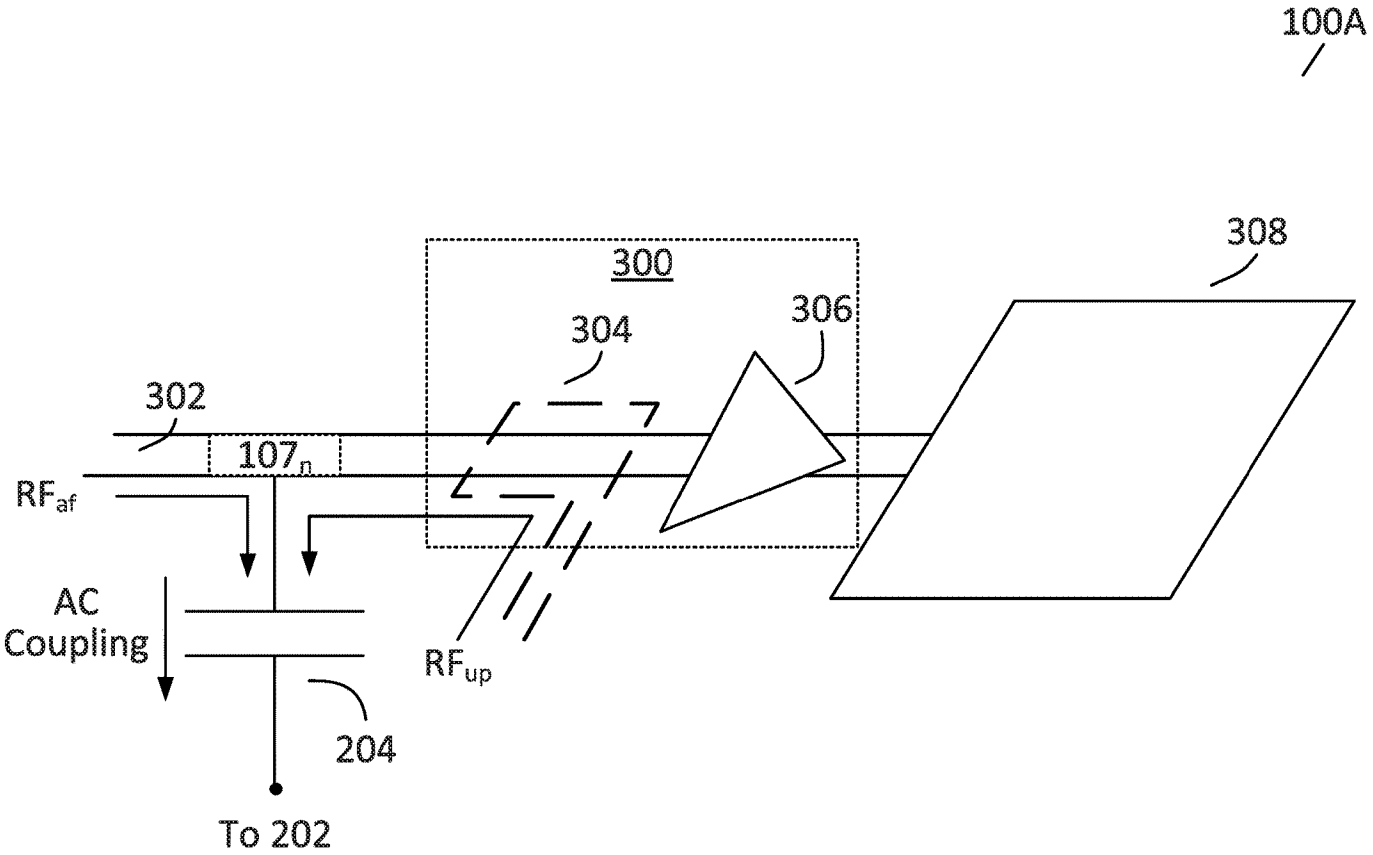
FIG. 3A is a block diagram illustrating a passive coupling circuit that may be used in the embodiment of FIG. 1A, in accordance with example embodiments described herein.

FIG. 3A shows an embodiment passive coupler circuit 300 that may be used in the transmit beam-steering IC 100A of FIG. 1A during calibration. A signal line 302 is coupled to a contact pad 308 that is used as an IC-to-channel output terminal of the IC 100A. The signal line 302 receives the $RF_{af}$ signal. A buffer 306 is connected to the signal line in series and prior to the contact pad 308. This buffer 306 can be configured such that a similar reference impedance is provided to all channel transmit paths of the IC 100A. A passive coupling element 304 runs underneath the signal line at a point prior to the buffer 306. When the IC 100A is in calibration mode, the passive coupling element 304 passively couples the $RF_{up}$ signal to output node $\mathbf{107}_1$ of signal line 302, which is an outermost point of the signal line 302 adjacent to buffer 306. Capacitor 204 of a downconverting mixer circuit is coupled to the output node $\mathbf{107}_1$ and receives both the $RF_{af}$ signal and the $RF_{up}$ signal. The capacitor 204 couples the AC component of these signals to the diode 202 of the downconverting mixer circuit.

Figure 3B:
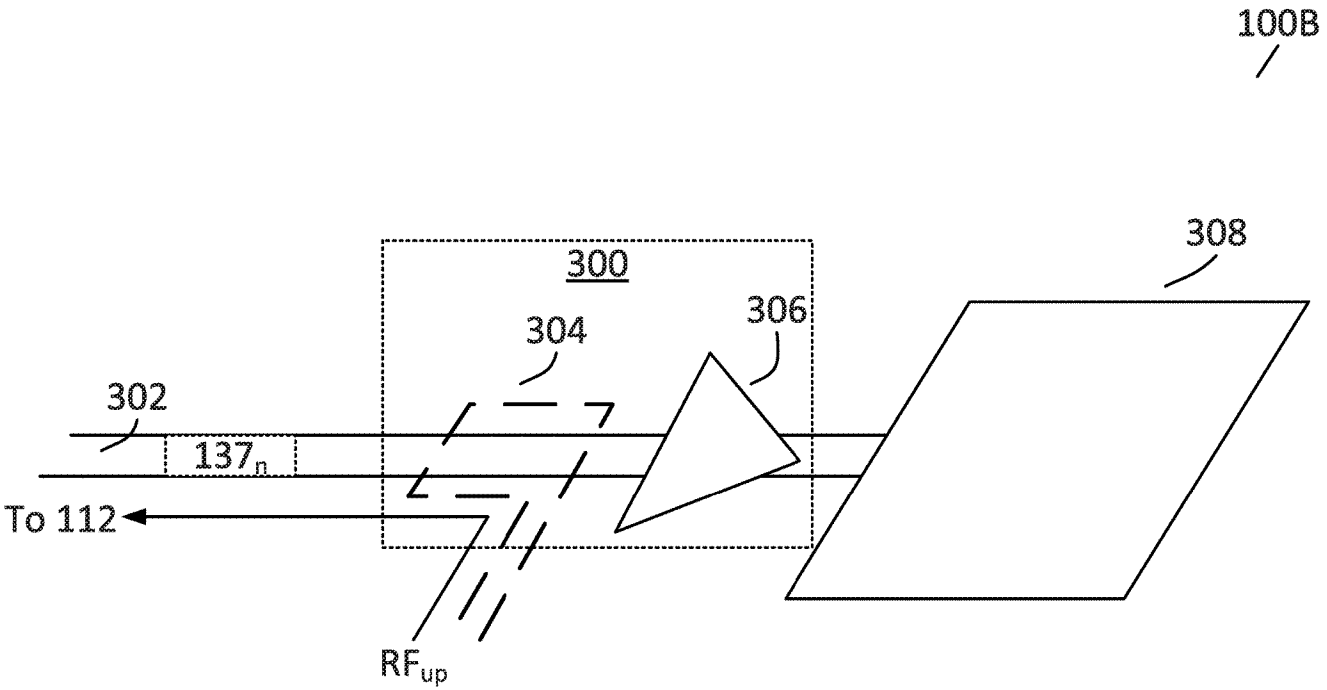
FIG. 3B is a block diagram illustrating a passive coupling circuit that may be used in the embodiment of FIG. 1B, in accordance with example embodiments described herein.

FIG. 3B shows the embodiment passive coupler circuit 300 as configured for use in the receive beam-steering IC 100B of FIG. 1B during calibration. The contact pad 308 is used as an channel-to-IC input terminal of the IC 100B. In an embodiment, when the IC 100B is in calibration mode, no signal is input to the IC 100B via the contact pad 308, and buffer 306 is disabled, i.e. configured to provide an isolating input impedance between the IC 100B and the contact pad 308. The passive coupling element 304 passively couples the $RF_{up}$ signal to input node $\mathbf{137}_1$ of signal line 302, which is an outermost point of the signal line 302 adjacent to buffer 306, and which provides the signal to an adjustable phase rotation circuit 112 of IC 100B.

Figure 4A:
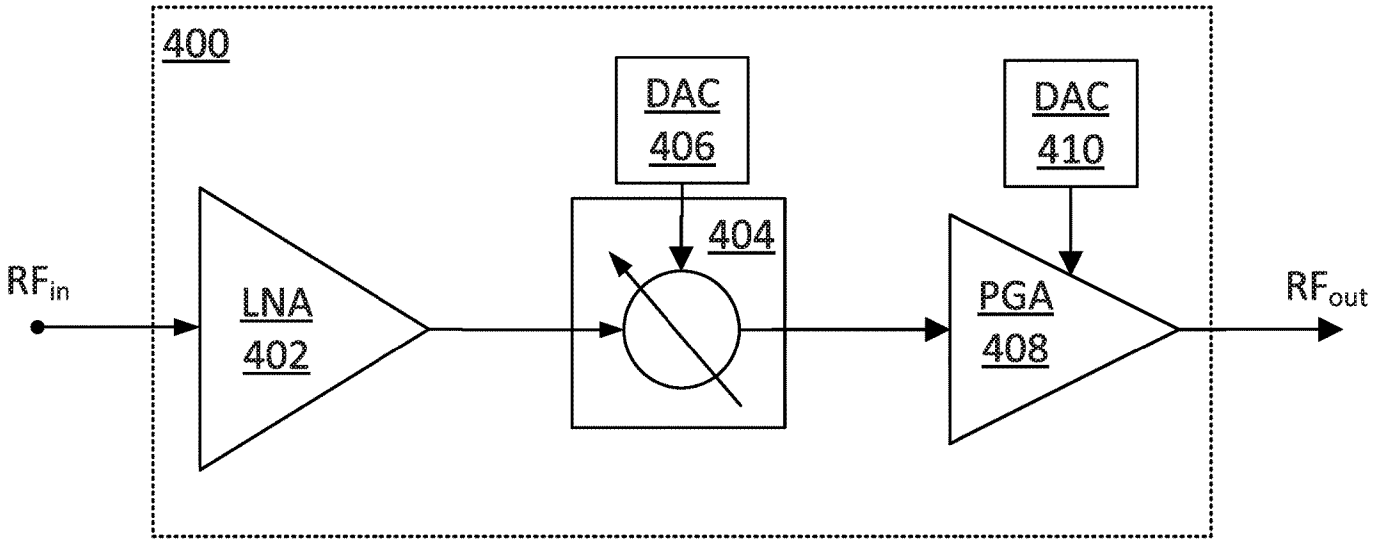
FIG. 4A is a block diagram illustrating an adjustable phase rotation circuit that may be used in the embodiments of FIG. 1A and FIG. 1B, in accordance with example embodiments described herein.

FIG. 4A shows an embodiment adjustable phase rotation circuit 400 that may be used as the adjustable phase rotation circuit 112 of FIG. 1A and FIG. 1B. Phase rotation circuit 400 includes a Low-Noise Amplifier (LNA) 402, a vector-modulating phase shifter 404 coupled to a Digital to Analog Converter (DAC) 406, and a Programmable Gain Amplifier (PGA) 408 coupled to another DAC 410. The LNA 402 amplifies an RF signal received by the circuit 400 and provides this amplified RF signal to the phase shifter 404. The phase shifter 404 rotates the phase of the RF signal in accordance with a digital phase shift setting received at the DAC 406, which may be, for example, a 5-bit digital word. The phase-rotated RF signal is then amplified by PGA 408 in accordance with a digital amplification setting received at the DAC 410, which may be, for example, a 5-bit digital word. The RF signal that is output from the PGA 407 is provided as an output of circuit 400.

Figure 4B:
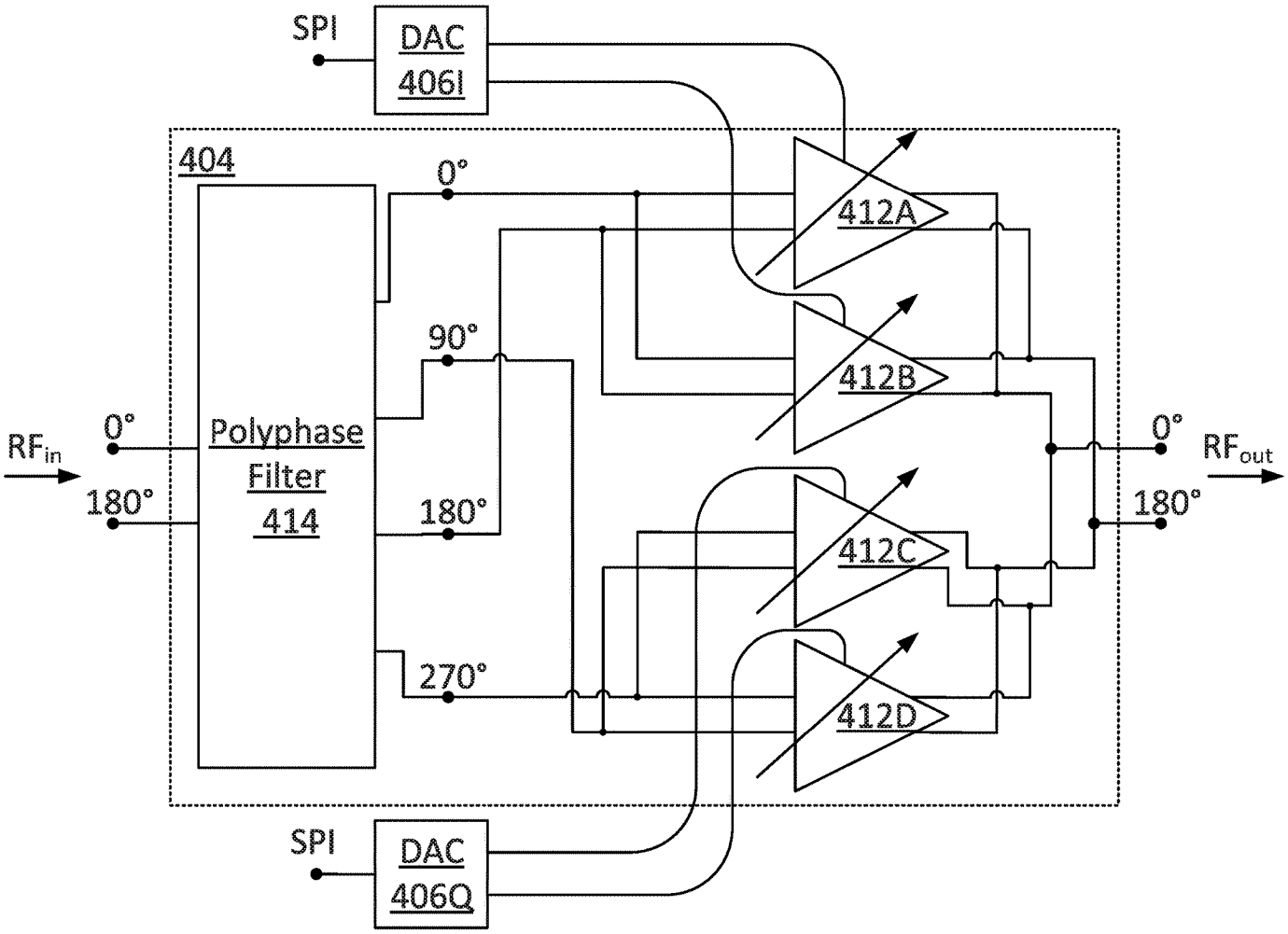
FIG. 4B is a block diagram illustrating a vector-modulating phase shifter circuit that may be used in the adjustable phase rotation circuit of FIG. 4A, in accordance with example embodiments described herein.

FIG. 4B shows a vector-modulating phase shifter 404 that may be used in the adjustable phase rotation circuit 400 of FIG. 4A. An RF input signal $RF_{in}$ upon entering the phase shifter 404 is a differential signal that may be considered as two component signals: a component that is the part of the $RF_{in}$ signal from the point of zero-degrees phase (relative to the overall $RF_{in}$ signal) up to but not including the point of 180 degree relative phase, and a component that is the remaining part of the $RF_{in}$ signal from the 180-degree phase point onward. Both these component signals are provided to a polyphase filter 414. The polyphase filter 414 outputs four component signals of $RF_{in}$: "zero-degree" component from [0,90) degrees of relative phase, a "90-degree" component from [90,180) degrees of relative phase, a "180 degree" component from [180,270) degrees of relative phase, and a "270 degree" component from [270,360) degrees of relative phase, all relative to the overall phase of $RF_1$. The zero-degree phase and the 180-degree component are both provided to an adjustable amplifier 412A and to an adjustable amplifier 412B, both of which receive an amplification setting from DAC 4061. The 90-degree and the 270-degree components are both provided to an adjustable amplifier 412C and to an adjustable amplifier 412D, both of which receive an amplification setting from DAC 406Q.

The DAC 4061 adjusts amplifiers 412A and 412B in accordance with a digital amplification setting for the I component of $RF_{in}$, which digital setting DAC 4061 receives via a Serial Programming Interface (SPI) connection. The DAC 406Q adjusts amplifiers 412C and 412D in accordance with a digital amplification setting for the Q component of $RF_{in}$, which digital setting is also received via an SPI connection. After amplification, the zero-degree signal that has been amplified by amplifier 412A is combined with the 180-degree signal that has been amplifier by amplifier 412B, the 90-degree signal that has been amplified by amplifier 412C, and the 270-degree signal that has been amplified by amplifier 412D to form the 0-to-180 degree component of output RF signal $RF_{out}$. The 180-degree signal that has been amplified by amplifier 412A is combined with the zero-degree signal that has been amplifier by amplifier 412B, the 270-degree signal that has been amplified by amplifier 412C, and the 90-degree signal that has been amplified by amplifier 412D to form the remaining portion of output RF signal $RF_{out}$ from 180 degrees onward.

Figure 4C:
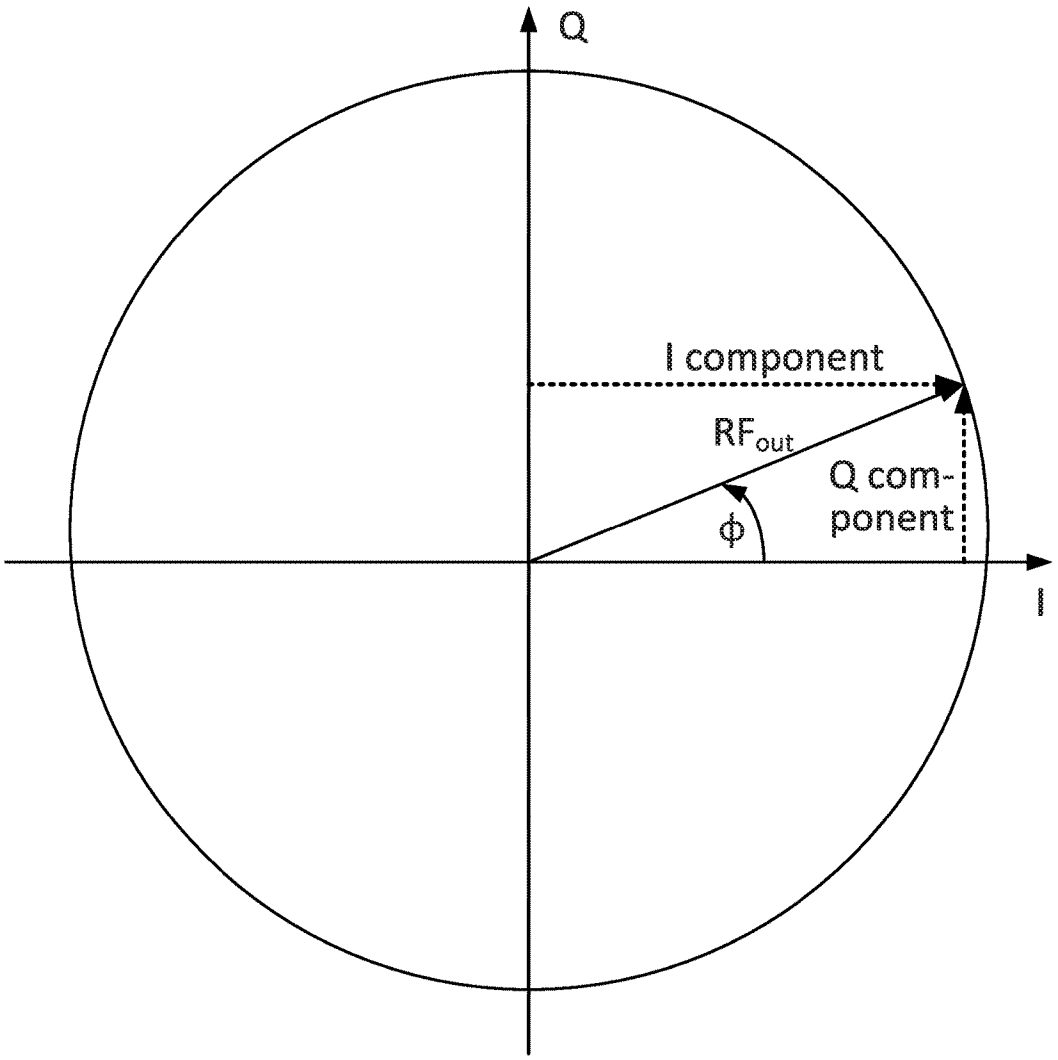
FIG. 4C is a chart illustrating vector addition by the vector-modulating phase shifter circuit of FIG. 4B, in accordance with example embodiments described herein.

FIG. 4C is a chart that illustrates using the unit circle how relative amplification of the I component of $RF_{out}$ (parallel to the horizontal axis) versus the Q component of $RF_{out}$ (parallel to the vertical axis) may change the phase angle $\varphi$ of the overall signal vector of $RF_{out}$. Referring back to FIG. 4B, the digital amplification settings for the I and Q components may thus be set such that a desired phase angle is applied at $RF_{out}$ relative to the overall phase of $RF_{in}$.

Figure 5A:
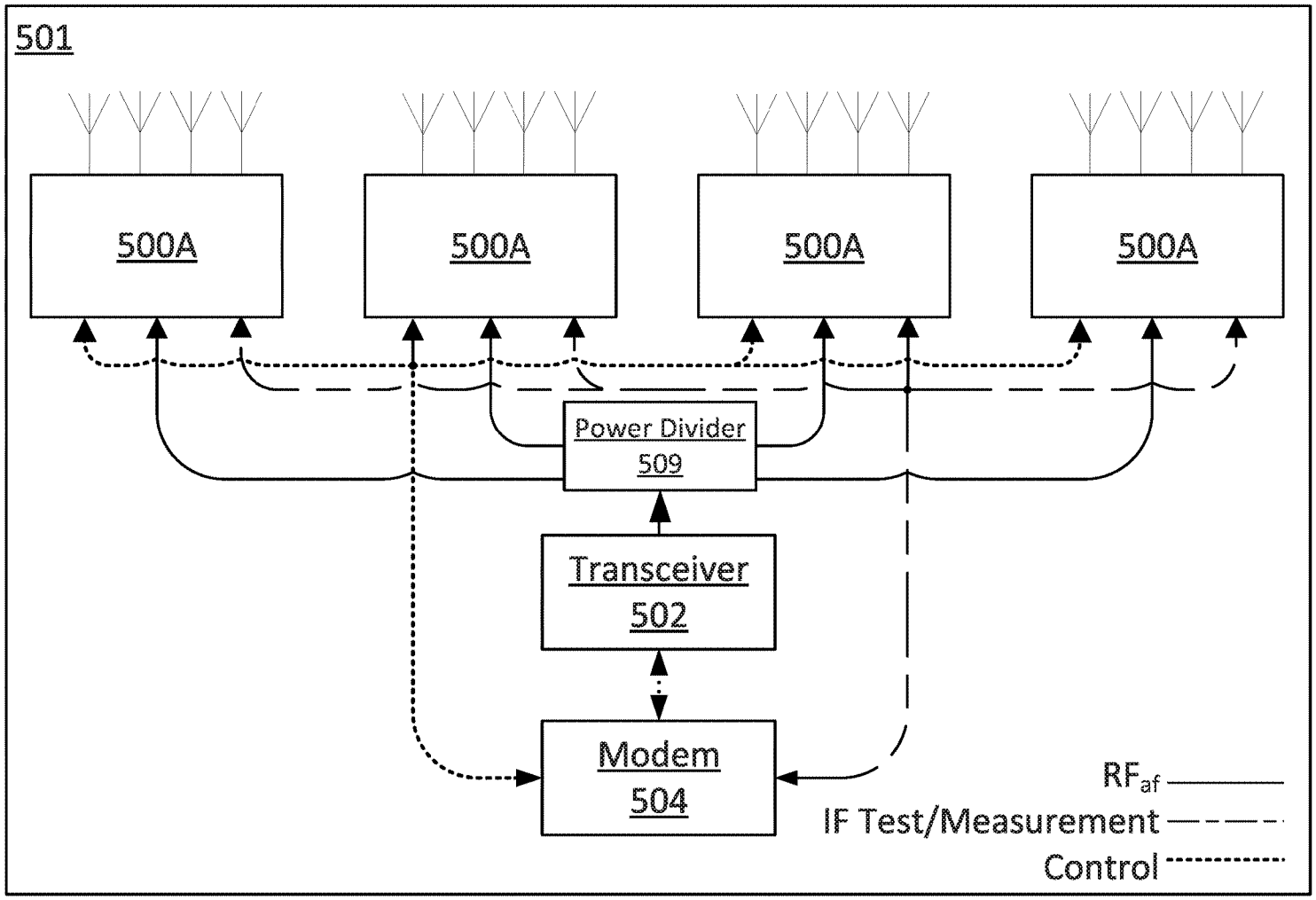
FIG. 5A is a block diagram illustrating a system having multiple multi-channel beam-steering ICs used together to build a large transmit phased array, in accordance with example embodiments described herein.

FIG. 5A shows an embodiment system having multiple multi-channel beam-steering ICs 500A that are transmit configured and are used together to build an even larger transmit phased array. Beam-steering ICs 500A are mounted on a PCB 501. An IF test tone generated by a modem 504 is provided to the multiple beam-steering ICs 500A along a respective transmission line having the same propagation phase change as that of the transmission line to any other of the beam-steering ICs 500A. The modem 504 also receives an IF measurement signal from the multiple beam-steering ICs 500A using, for example, the same transmission lines. The modem 504 also has a separate control channel to the beam-steering ICs 500A for providing control information and receiving control feedback. This control channel may be, for example, an SPI channel.

In the embodiment of FIG. 5A, an array-frequency signal $RF_{af}$ generated by a transceiver IC 502 is provided by the transceiver IC 502 to a power divider 509. Power divider 509 splits the array-frequency signal $RF_{af}$ into multiple signals that are respectively provided to each beam-steering IC 500A along a respective transmission line having the same propagation phase change as that of the transmission line to any other of the beam-steering ICs 500A. In other embodiments, $RF_{af}$ may be generated by an oscillator on one of the ICs 500A and may be provided to the other ICs 500A in a manner similar to that of FIG. 5A using signal paths having a same phase change.

Figure 5B:
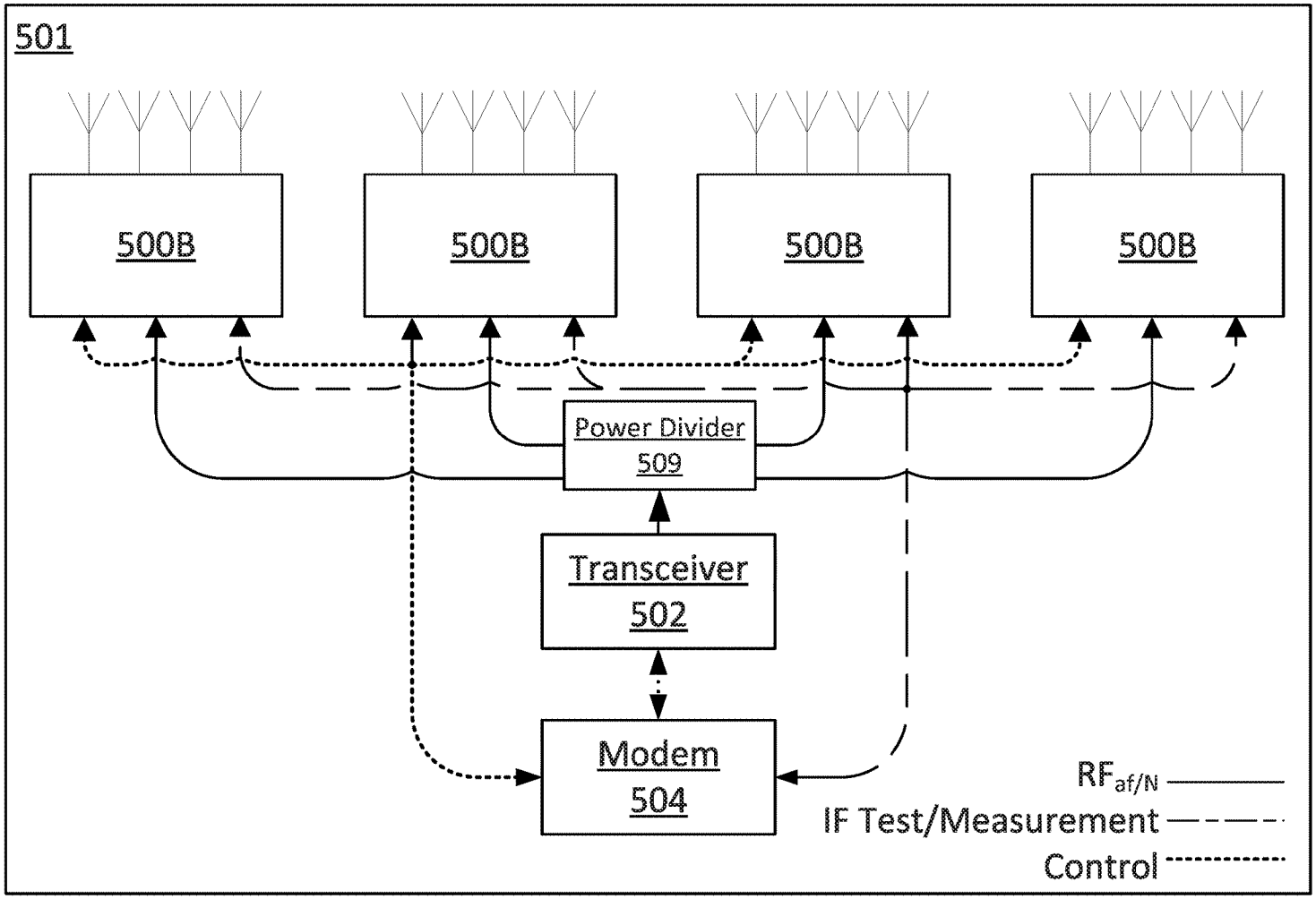
FIG. 5B is a block diagram illustrating a system having multiple multi-channel beam-steering ICs used together to build a large receive phased array, in accordance with example embodiments described herein.

FIG. 5B shows an embodiment system having multiple receive-configured beam-steering ICs 500B that have multiple channels and that are used together to build an even larger receive phased array. An IF test tone, measurement signals, and control signals are generated for each of the ICs 500B in a similar manner as already described for FIG. 5A. Instead of generating the array-frequency signal $RF_{af}$, however, a signal $RF_{af/N}$ having a frequency N time less than that of $RF_{af}$ is generated by transceiver IC 502 and is provided by the transceiver IC 502 to a power divider 509. Power divider 509 splits signal $RF_{af/N}$ into multiple signals that are respectively provided to each beam-steering IC 500B along a respective transmission line having the same propagation phase change as that of the transmission line to any other of the beam-steering ICs 500B.

Figure 5C:
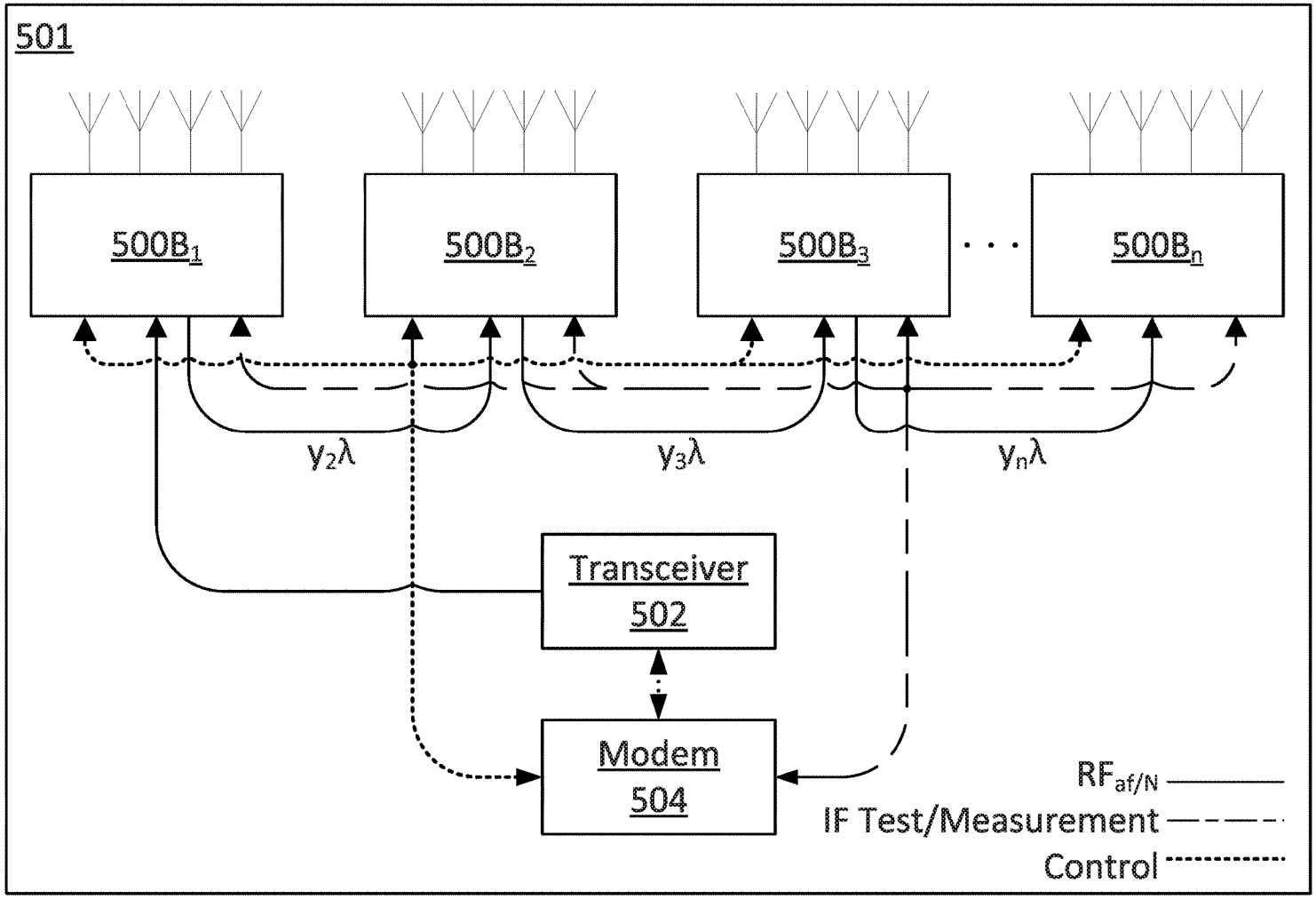
FIG. 5C is a block diagram illustrating an alternative embodiment of the receive phased array system of FIG. 5B.

FIG. 5C shows an alternative embodiment of the multi-IC receive phased array of FIG. 5B that does not include power divider 509. Instead, transceiver IC 502 provides signal $RF_{af}$ to a first beam-steering IC $\mathbf{500}B_1$. IC $\mathbf{500}B_1$ then provides signal $RF_{af/N}$ to IC $\mathbf{500}B_2$ along a transmission line having a known propagation phase change $y_2\lambda$, which then provides signal $RF_{af/N}$ to IC $\mathbf{500}B_3$ along a transmission line having a known propagation phase change $y_n\lambda$, and so on, such that signal $RF_{af/N}$ is provided to all the ICs $\mathbf{500}B_1$ to $\mathbf{500}B_n$. These transmission lines may provide, for example, a same relative phase for each of ICs $\mathbf{500}B_1$ to $\mathbf{500}B_n$ at a particular frequency.

Figure 6:
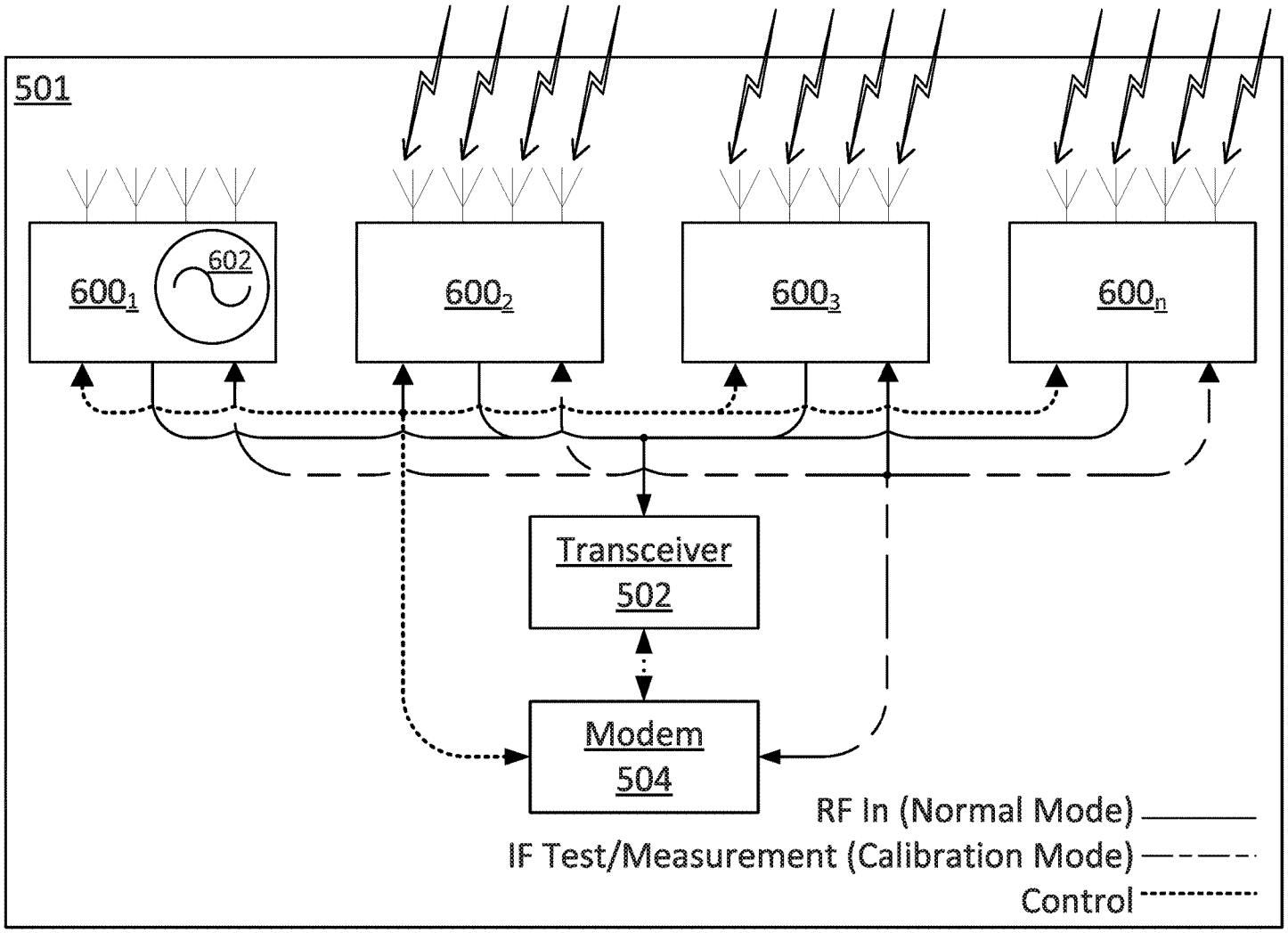
FIG. 6 is a block diagram illustrating an alternative system having multiple multi-channel beam-steering ICs used together to build a large receive phased array, in accordance with example embodiments described herein.

FIG. 6 shows an alternative embodiment system having multiple receive-configured beam-steering ICs $\mathbf{600}_1$-$\mathbf{600}_n$. An IF test tone is generated by Modem 504 and provided to the ICs $\mathbf{600}_1$-$\mathbf{600}_n$ is a similar manner as already described for FIG. 5B. An oscillator 602 (e.g., a VCO) on one IC $\mathbf{600}_1$ may be used to generate the array-frequency signal and calibrate all the channel receive paths for that IC, in a similar manner as that already described in reference to FIG. 1B.

For IC $\mathbf{600}_1$, the phase information of a first channel receive path is used as a reference phase to calibrate the phase rotation of IC $\mathbf{600}_1$'s non-reference channel receive paths using the selected receive path measurement signal. The calibration of each of these channel receive paths of IC $\mathbf{600}_1$ during calibration mode results in a phase correction value. This phase correction value is to be used during a normal operation mode in which RF received at the antennas is phase-adjusted by the receive paths and provided to transceiver IC 502. In particular, during normal operation mode the phase correction value may be used to adjust phase control signals sent by modem 504 to IC $\mathbf{600}_1$ such that the phase change over each of IC $\mathbf{600}_1$'s channel receive paths to their common node (as shown for the IC 100B in FIG. 1B) differs by a constant phase angle from channel-to-channel. The phase correction value of the final channel receive path of the IC $\mathbf{600}_1$, i.e., the receive path that has the greatest propagation distance from the reference receive path, is then used in calibrating the other ICs $\mathbf{600}_2$-$\mathbf{600}_n$.

An alternative calibration method may be based on an array-frequency signal transmitted over the air to be received by the set of antennas coupled to IC $\mathbf{600}_2$. The system sweeps the phase rotation value of the reference (e.g., first) channel receive path of the IC $\mathbf{600}_1$ while monitoring the signal strength of the measurement signal of the reference channel receive path of IC $\mathbf{600}_2$. The system determines a signal peak of this measurement signal, and uses the corresponding phase rotation value for the phase correction value of the reference receive path of the IC $\mathbf{600}_1$ and for calibrating other channel receive paths. In some embodiments, the swept increase is controlled in the digital domain and is applied to phase shifters of the IC $\mathbf{600}_1$ using one or more DACs.

Referring again to FIG. 6, the system may then determine the phase correction values for any of the non-reference receive paths for the IC $\mathbf{600}_2$ either by using an array-frequency signal generated within the system in the same manner as for the non-reference receive paths of IC $\mathbf{600}_1$, or by using the over-the-air array-frequency signal. Once IC $\mathbf{600}_2$ has been calibrated, IC $\mathbf{600}_3$ may be calibrated in the same manner as IC $\mathbf{600}_2$, and so on for all the ICs $\mathbf{600}_3$-$\mathbf{600}_n$.

Figure 7:
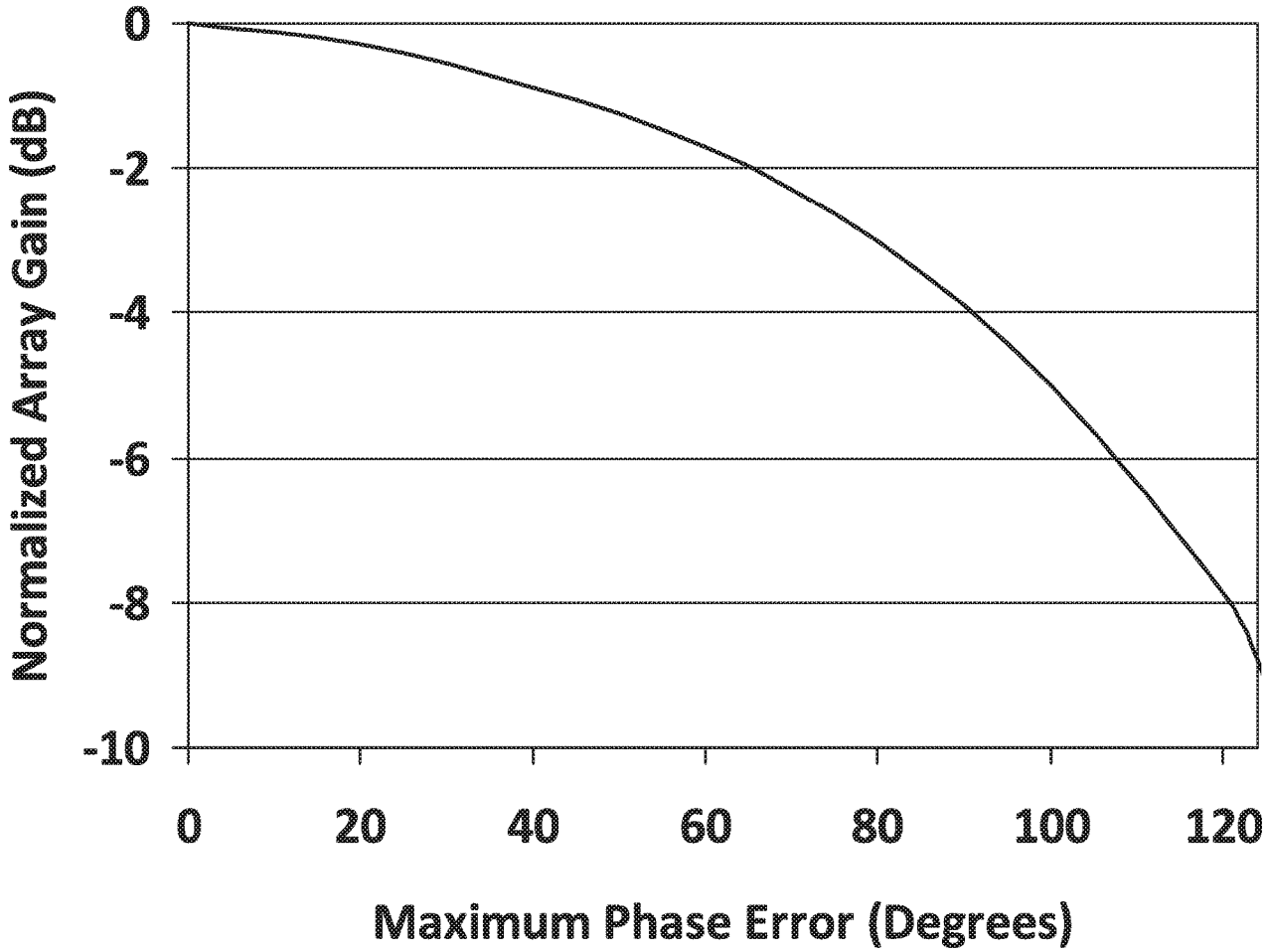
FIG. 7 is a graph illustrating the resulting decrease in receive phase error with increased array gain due to calibrating a transmit or receive array, in accordance with example embodiments described herein.

FIG. 7 shows the resulting decrease in receive phase error with increased array gain that may occur when phase measurement signals are used to calibrate a transmit or receive array with appropriate phase corrections for each channel. For a transmit phased array, a wrong phase adjustment of one of the channels may lead to a wider antenna beam that is not focusing exactly in the expected direction. A lower gain can therefore be expected when this signal is received. For a receive phased array, a wrong phase adjustment of one of the channels may also lead to a lower gain of the received signal. Conversely, if the channels of the receive or transmit phased array are properly adjusted using appropriate phase correction values, normalized gain of the received signal is increased. As shown in FIG. 7, such increased gain reduces the maximum phase error of symbols in the received constellation.

Figure 8:
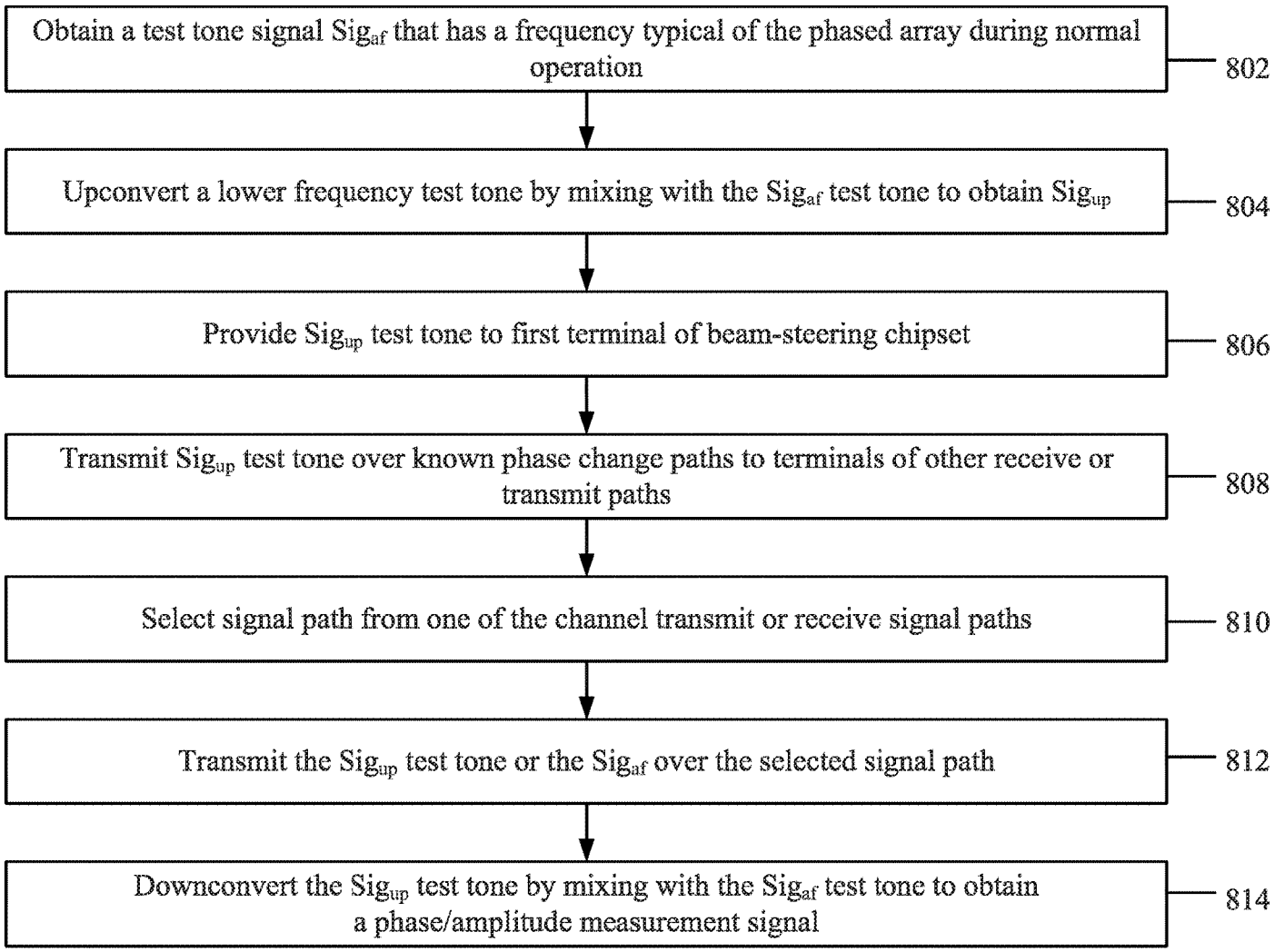
FIG. 8 is a flow diagram illustrating a method for obtaining a phase measurement signal from a beam-steering IC, in accordance with example embodiments described herein.

FIG. 8 shows a flow diagram of an embodiment method for obtaining a phase measurement signal from a beam-steering IC. At step 802, a test tone signal $Sig_{af}$ having a frequency that would be in the band of signals transmitted or received at an antenna of the phased array during normal operation, i.e., an array-frequency test tone, is obtained by a beam-steering IC. The $Sig_{af}$ signal may be generated either externally or by an oscillator on the IC. At step 804, a lower frequency test tone is obtained by the IC, and is upconverted by mixing it with the $Sig_{af}$ signal to obtain an upconverted test tone signal $Sig_{up}$. As an example, $Sig_{af}$ may be a 60 GHz test tone, the lower frequency test tone may be a 10 MHz test tone, and $Sig_{up}$ may be a 60.01 GHz test tone. At step 806, $Sig_{up}$ is provided to a first input or output node of a beam-steering IC. This first node is located between a first external antenna and a first signal path, which is a channel receive path or a channel transmit path and which includes an adjustable phase rotation circuit. At step 808, the upconverted test tone $Sig_{up}$ is transmitted from the first node over one or more paths having known propagation phase changes to one or more additional nodes of the IC, which are located between external antennas and channel receive or transmit paths that each include an adjustable phase rotation circuit. At step 810, a signal path is selected from one of the channel transmit or receive signal paths. At step 812, one of $Sig_{up}$ and $Sig_{af}$ is transmitted over the selected signal path. At step 814, the upconverted test tone $Sig_{up}$ is downconverted by mixing it with the array-frequency test tone $Sig_{af}$ to obtain a measurement signal that contains phase information of the selected signal path, and that may also contain amplitude information for the selected signal path. As an example, a 60.01 GHz $Sig_{up}$ test tone may be downconverted by mixing it with a 60 GHz $Sig_{af}$ test tone to obtain a 10 MHz measurement signal.

Figure 9:
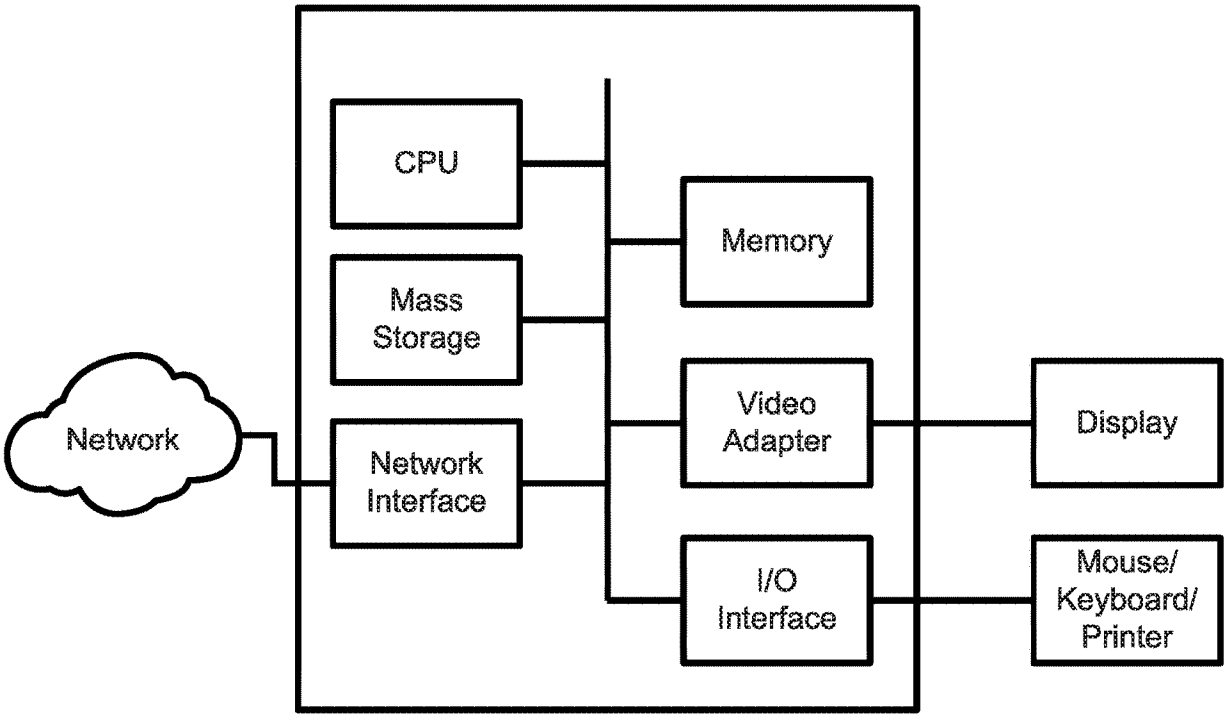
FIG. 9 is a block diagram of a processing system that may be used for implementing some of the devices and methods disclosed herein in accordance with embodiments of the present invention.

FIG. 9 shows a block diagram of a processing system that may be used for implementing some of the devices and methods disclosed herein. Specific devices may utilize all of the components shown, or only a subset of the components, and levels of integration may vary from device to device. Furthermore, a device may contain multiple instances of a component, such as multiple processing units, processors, memories, transmitters, receivers, etc. In an embodiment, the processing system comprises a computer workstation. The processing system may comprise a processing unit equipped with one or more input/output devices, such as a speaker, microphone, mouse, touchscreen, keypad, keyboard, printer, display, and the like. The processing unit may include a CPU, memory, a mass storage device, a video adapter, and an I/O interface connected to a bus. In an embodiment, multiple processing units in a single processing system or in multiple processing systems may form a distributed processing pool or distributed editing pool.

The bus may be one or more of any type of several bus architectures including a memory bus or memory controller, a peripheral bus, video bus, or the like. The CPU may comprise any type of electronic data processor. The memory may comprise any type of system memory such as random access memory (RAM), static RAM (SRAM), dynamic RAM (DRAM), synchronous DRAM (SDRAM), read-only memory (ROM), a combination thereof, or the like. In an embodiment, the memory may include ROM for use at boot-up, and DRAM for program and data storage for use while executing programs.

The mass storage device may comprise any type of storage device configured to store data, programs, and other information and to make the data, programs, and other information accessible via the bus. The mass storage device may comprise, for example, one or more of a solid state drive, hard disk drive, a magnetic disk drive, an optical disk drive, or the like.

The video adapter and the I/O interface provide interfaces to couple external input and output devices to the processing unit. As illustrated, examples of input and output devices include the display coupled to the video adapter and the mouse/keyboard/printer coupled to the I/O interface. Other devices may be coupled to the processing unit, and additional or fewer interface cards may be utilized. For example, a serial interface such as Universal Serial Bus (USB) (not shown) may be used to provide an interface for a printer.

The processing unit also includes one or more network interfaces, which may comprise wired links, such as an Ethernet cable or the like, and/or wireless links to access nodes or different networks. The network interface allows the processing unit to communicate with remote units via the networks. For example, the network interface may provide wireless communication via one or more transmitters/transmit antennas and one or more receivers/receive antennas. In an embodiment, the processing unit is coupled to a local-area network or a wide-area network for data processing and communications with remote devices, such as other processing units, the Internet, remote storage facilities, or the like. The network interface may be configured to have various connection-specific virtual or physical ports communicatively coupled to one or more of these remote devices.

Illustrative embodiments of the present invention have the advantage of providing precise measurement of channel transmit or receive path phase adjustment to allow accurate calibration and beam-steering of phased arrays. An embodiment system may support a phased array that uses a large number of antennas to narrow the beam width and to reduce the output power that must be radiated by each antenna while achieving the same maximum equivalent isotropically radiated power.

The following additional example embodiments of the present invention are also provided. In accordance with a first example embodiment of the present invention, a method for signal path measurement is provided. The method includes providing a first signal at a common node coupled to a plurality of signal paths that each include a respective phase rotation circuit. The method also includes providing a second signal, over a first test path, to a first node coupled to a first signal path of the plurality of signal paths. The method also includes providing the second signal, over a second test path, to a second node coupled to a second signal path of the plurality of signal paths, such that a difference in phase delay between the second test path and the first test path includes a first known phase delay. The method also includes selecting a signal path from the plurality of signal paths, transmitting, over the selected signal path, one of the first signal and the second signal, and mixing the first signal with the second signal to obtain a measurement signal of the selected signal path.

Also, the foregoing first example embodiment may be implemented to include one or more of the following additional features. The method may also be implemented such that the measurement signal includes phase information of the selected signal path, the first node includes an output node of the first signal path, and the method further includes rotating, by a phase rotation circuit of the selected signal path, the first signal. The method may also be implemented such that the measurement signal includes phase information of the selected signal path, the first node includes an input node of the first signal path, providing the first signal includes generating the first signal by a voltage controlled oscillator, and the method further includes rotating, by a phase rotation circuit of the selected signal path, the second signal.

The method may also be implemented such that the second test path includes the first test path, the second node includes a plurality of second nodes each coupled to the first node by a respective inter-node path having a respective one of a plurality of known phase delays to include the first known phase delay. In such an embodiment, each of the plurality of second nodes is coupled to a respective one of the plurality of signal paths, and each of the plurality of signal paths terminates at the common node.

The method may also be implemented such that the selected signal path is different from the first signal path, and the method further includes obtaining stored phase information of a measurement signal of the first signal path, and selecting a propagation delay from one of the plurality of known phase delays, in accordance with the selected signal path. In such an embodiment, the method further includes measuring a phase difference between the first signal path and the selected signal path in accordance with the stored phase information, the phase information of the measurement signal of the selected signal path, and the selected propagation delay.

The method may also be implemented such that a first phase difference includes a difference between a phase delay over the second signal path relative to a phase delay over the first signal path, a second phase difference includes a difference between a phase delay over a third signal path of the plurality of signal paths relative to a phase delay over the second signal path, and the method further includes adjusting a phase rotation circuit of the second signal path and a phase rotation circuit of the third signal path such that the first phase difference is the same as the second phase difference.

The method may also be implemented such that a measurement signal of the first signal path further includes amplitude information, the selected signal path is not the first signal path, and the measurement signal of the selected signal path further includes amplitude information. In such an embodiment, the method further includes obtaining stored amplitude information of the measurement signal of the first signal path, and measuring a difference between an amplitude change of the first signal path and an amplitude change of the selected signal path in accordance with the stored amplitude information and the amplitude information of the measurement signal of the selected signal path.

The method may also be implemented further to include receiving a third signal to include a frequency that is different than a frequency of the first signal, and mixing the first signal in accordance with the third signal to obtain the second signal.

The method may also be implemented such that a first semiconductor device includes the plurality of signal paths, a second semiconductor device includes a structure identical to the first semiconductor device, and a first transmission path from a third semiconductor device to the first semiconductor device has the same phase delay as a second transmission path from the third semiconductor device to the second semiconductor device. In such an embodiment, the providing the first signal at the first node includes generating, by the third semiconductor device, the first signal, and transmitting the first signal from the third semiconductor device to the first semiconductor device over the first transmission path. In such an embodiment, the method further includes transmitting the first signal from the third semiconductor device to the second semiconductor device over the second transmission path.

The method may also be implemented such that a third transmission path from a fourth semiconductor device to the first semiconductor device has the same phase delay as a fourth transmission path from the fourth semiconductor device to the second semiconductor device. In such an embodiment, the method further includes generating, by the fourth semiconductor device, the third signal, transmitting the third signal from the fourth semiconductor device to the first semiconductor device over the third transmission path, and transmitting the first signal from the fourth semiconductor device to the second semiconductor device over the fourth transmission path.

The method may also be implemented such that a second semiconductor device includes a fourth signal path, the second semiconductor device is distinct from a semiconductor device that includes the first signal path, and a fourth node is coupled to the fourth signal path and an external antenna of the second semiconductor device. In such an embodiment, the method further includes obtaining, at the fourth node, a fourth signal received at the external antenna of the second semiconductor device, and setting a phase rotation value of the first signal path. In such an embodiment, the method further includes determining a measurement signal of the fourth signal path to include phase information of the fourth signal path, in accordance with the third signal, the fourth signal, and the phase rotation value of the first signal path. In such an embodiment, the method further includes increasing the phase rotation value of the first signal path to a phase rotation value that maximizes a signal amplitude of the measurement signal of the fourth signal path.

The following additional example embodiments of the present invention are also provided. In accordance with a second example embodiment of the present invention, a measurement circuit is provided. The measurement circuit includes a first semiconductor device. The first semiconductor device includes a plurality of signal paths that each include a respective phase rotation circuit. The first semiconductor device also includes a first node coupled to a first signal path of the plurality of signal paths, a second node coupled to a second signal path of the plurality of signal paths, and a common node coupled to the plurality of signal paths. The first semiconductor device is configured to provide a first signal at the common node, to provide a second signal to the first node over a first test path, to provide the second signal to the second node over a second test path, to transmit, over a selected signal path of the plurality of signal paths, one of the first signal and the second signal, and to mix the first signal with the second signal to obtain a measurement signal of the selected signal path. A difference in phase delay between the second test path and the first test path includes a first known phase delay.

Also, the foregoing second example embodiment may be implemented to include one or more of the following additional features. The measurement circuit may also be implemented such that the first semiconductor device is further configured to receive a third signal that includes a third frequency that is different than a frequency of the first signal, and to mix the first signal in accordance with the third signal to obtain the second signal. The measurement circuit may also be implemented such that the measurement signal of the selected signal path includes phase information of the selected signal path, the first node includes an output node of the first signal path, and a phase rotation circuit of the selected signal path is configured to rotate the first signal. The measurement circuit may also be implemented such that the measurement signal of the selected signal path includes phase information of the selected signal path, the first node includes an input node of the first signal path, the first semiconductor device further includes a voltage controlled oscillator configured to generate the first signal, and a phase rotation circuit of the selected signal path is configured to rotate the second signal.

The measurement circuit may also be implemented such that the second test path includes the first test path, and the first semiconductor device further includes a second node that includes a plurality of second nodes coupled to the first node by a respective inter-node path having a respective one of a plurality of known phase delays that include the first known phase delay. In such an embodiment, each of the plurality of second nodes is coupled to a respective one of the plurality of signal paths, and each of the plurality of signal paths terminates at the common node of the first semiconductor device.

The measurement circuit may also be implemented further to include a second semiconductor device coupled to the plurality of signal paths of the first semiconductor device. In such an embodiment, the second semiconductor device is configured to obtain stored phase information of a measurement signal of the first signal path and to measure a phase difference between the first signal path and the selected signal path in accordance with the stored phase information, the phase information of the measurement signal of the selected signal path, and a phase delay selected in accordance with the selected signal path from one of the plurality of known phase delays.

The measurement circuit may also be implemented such that a measurement signal of the first signal path further includes amplitude information, the selected signal path is different from the first signal path, and the measurement signal of the selected signal path further includes amplitude information. In such an embodiment, the first semiconductor device is further configured to obtain stored amplitude information of the measurement signal of the first signal path and to measure a difference between an amplitude change of the first signal path and an amplitude change of the selected signal path in accordance with the stored amplitude information and the amplitude information of the measurement signal of the selected signal path.

The measurement circuit may also be implemented further to include a second semiconductor device coupled to the plurality of signal paths of the first semiconductor device. In such an embodiment, a first phase difference includes a difference between a phase delay over the second signal path relative to a phase delay over the first signal path, a second phase difference includes a difference between a phase delay over a third signal path of the plurality of signal paths relative to a phase delay over the second signal path, and the second semiconductor device is further configured to adjust a phase rotation circuit of the second signal path and a phase rotation circuit of the third signal path such that the first phase difference is the same as the second phase difference.

The following additional example embodiments of the present invention are also provided. In accordance with a third example embodiment of the present invention, a measurement system is provided. The measurement system includes a first semiconductor device. The first semiconductor device includes a plurality of signal paths coupled to each other at a common node and a plurality of test paths that include a first test path and a second test path. The first semiconductor device also includes a reference node coupled between the first test path and a first signal path of the plurality of signal paths, a non-reference node coupled between the second test path and a second signal path of the plurality of signal paths, and a first frequency mixer that includes an input coupled to one of the reference node and the common node. The first semiconductor circuit also includes a measurement output node coupled to an output of the first frequency mixer such that a difference in phase delay between the second test path and the first test path includes a first known phase delay. Each of the plurality of signal paths includes a respective phase rotation circuit.

Also, the foregoing third example embodiment may be implemented to include one or more of the following additional features. The measurement system may also be implemented such that the first semiconductor device further includes a voltage controlled oscillator, a first input node coupled to a first input of a second frequency mixer, and a plurality of passive coupler circuits that includes a first passive coupler circuit coupled between an output of the second frequency mixer and the reference node. In such an embodiment, the first semiconductor device further includes the second frequency mixer that includes a single sideband mixer, the second test path includes the first test path and a first inter-node path, a phase delay of the first inter-node path includes the first known phase delay, and the first inter-node path includes a second passive couple circuit of the plurality of passive coupler circuits.

The measurement system may also be implemented such that each of the plurality of passive coupler circuits includes a respective buffer that includes the same reference impedance.

The measurement system may also be implemented such that the reference node is coupled to the input of the first frequency mixer, the reference node includes a first output node of the plurality of signal paths, the non-reference node includes a second output node of the plurality of signal paths, and the plurality of signal paths further includes a third signal path coupled to a third output node of the plurality of signal paths. In such an embodiment, the first semiconductor device further includes the third output node coupled to the reference node by a second inter-node path having a second known phase delay, a power divider coupled to the second input node (the power divider to include the common node), a third frequency mixer (that includes an input coupled to the second output node), and a fourth frequency mixer. In such an embodiment, the fourth frequency mixer includes an input coupled to the third output node, an output coupled to the measurement output node, and a switch that includes a plurality of inputs coupled to the output of the first frequency mixer, an output of the third frequency mixer, and an output of the fourth frequency mixer.

The measurement system may also be implemented such that the reference node includes a receive node of the first semiconductor device, and the first semiconductor device further includes a power combiner coupled to the input of the first frequency mixer, the power combiner to include the common node. In such an embodiment, the voltage controlled oscillator includes an output coupled to the input of the first frequency mixer and to the second input of the second frequency mixer.

The measurement system may also be implemented further to include an analog-to-digital converter that includes an output coupled to the measurement output node. In such an embodiment, the measurement system further includes a digital memory circuit coupled to the output of the analog-to-digital converter.

The measurement system may also be implemented further to include a second semiconductor device that includes a structure identical to the first semiconductor device. In such an embodiment, the measurement system further includes a third semiconductor device, a first transmission path coupled between the third semiconductor device and the second input node of the first semiconductor device, and a second transmission path coupled between the third semiconductor device and a frequency mixer included in the second semiconductor device. In such an embodiment, the second transmission path includes a phase delay that is the same as a phase delay of the first transmission path.

The measurement system may also be implemented such that the respective phase rotation circuit includes a first adjustable amplifier, a second adjustable amplifier, a polyphase filter, a first digital-to-analog converter to include an input coupled to a serial programming interface and an output coupled to the first adjustable amplifier, and a second digital-to-analog converter to include an input coupled to the serial programming interface and an output coupled to the second adjustable amplifier. In such an embodiment, the polyphase filter includes a first output coupled to the first adjustable amplifier, and a second output coupled to the second adjustable amplifier.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A measurement circuit comprising:

a first semiconductor device comprising a plurality of signal paths each comprising a respective phase rotation circuit, a first node coupled to a first signal path of the plurality of signal paths, the first node configured to be coupled to a first antenna of a phased array antenna;

a second node coupled to a second signal path of the plurality of signal paths, the second node configured to be coupled to a second antenna of the phased array antenna;

a common node coupled to the plurality of signal paths;

the first semiconductor device is configured to provide a first signal at the common node having a first frequency, provide a second signal to the first node over a first test path, the second signal having a second frequency different from the first frequency;

provide the second signal to the second node over a second test path, transmit, over a selected signal path of the plurality of signal paths, one of the first signal or the second signal, and mix the first signal with the second signal to obtain a measurement signal of the selected signal path, wherein a difference in phase delay between the second test path and the first test path comprises a first known phase delay; and a phase measurement circuit coupled to the plurality of signal paths of the first semiconductor device, the phase measurement circuit configured to obtain stored phase information of a measurement signal of the first signal path, and measure a phase difference between the first signal path and the selected signal path in accordance with the stored phase information, phase information of the measurement signal of the selected signal path, and the first known phase delay corresponding to the selected signal path from one of a plurality of known phase delays.

2. The measurement circuit of claim 1, wherein the first semiconductor device is further configured to:

receive a third signal comprising a third frequency that is different than a frequency of the first signal; and mix the first signal with the third signal to obtain the second signal.

3. The measurement circuit of claim 1, wherein:

the measurement signal of the selected signal path comprises phase information of the selected signal path;

the first node comprises an output node of the first signal path; and a phase rotation circuit of the selected signal path is configured to rotate a phase of the first signal.

4. The measurement circuit of claim 1, wherein:

the measurement signal of the selected signal path comprises phase information of the selected signal path;

the first node comprises an input node of the first signal path;

the first semiconductor device further comprises a voltage controlled oscillator configured to generate the first signal; and a phase rotation circuit of the selected signal path is configured to rotate a phase of the second signal.

5. The measurement circuit of claim 1, wherein:

the second test path comprises the first test path;

the second node comprises a plurality of second nodes coupled to the first node by a respective inter-node path having a respective one of the plurality of known phase delays comprising the first known phase delay;

each of the plurality of second nodes is coupled to a respective one of the plurality of signal paths; and each of the plurality of signal paths terminates at the common node of the first semiconductor device.

6. The measurement circuit of claim 5, wherein:

the measurement signal of the first signal path further comprises amplitude information;

the selected signal path is different from the first signal path;

the measurement signal of the selected signal path further comprises amplitude information; and the first semiconductor device is further configured to obtain stored amplitude information of the measurement signal of the first signal path, and measure a difference between an amplitude change of the first signal path and an amplitude change of the selected signal path in accordance with: the stored amplitude information and the amplitude information of the measurement signal of the selected signal path.

7. The measurement circuit of claim 1, further comprising a second semiconductor device coupled to the plurality of signal paths of the first semiconductor device, wherein:

a first phase difference comprises a difference between a phase delay over the second signal path relative to a phase delay over the first signal path;

a second phase difference comprises a difference between a phase delay over a third signal path of the plurality of signal paths relative to the phase delay over the second signal path; and the second semiconductor device is further configured to adjust a phase rotation circuit of the second signal path and a phase rotation circuit of the third signal path such that the first phase difference is the same as the second phase difference.

8. The measurement circuit of claim 1, wherein:

the first node is a first output of the first signal path of the plurality of signal paths, wherein the first signal path of the plurality of signal paths comprises a first channel transmit signal path;

the second node is a second output of the second signal path of the plurality of signal paths, wherein the second signal path of the plurality of signal paths comprises a second channel transmit signal path; and the first semiconductor device is configured to transmit the first signal over the selected signal path of the plurality of signal paths.

9. The measurement circuit of claim 8, further comprising:

a first passive coupler configured to couple the first test path to the first output; and a second passive coupler configured to couple the second test path to the second output.

10. The measurement circuit of claim 9, wherein:

the first passive coupler comprises a first directional coupler; and the second passive coupler comprises a second directional coupler.

11. The measurement circuit of claim 9, further comprising:

a power divider coupled to inputs of the plurality of signal paths; and a plurality of mixers having respective inputs coupled to corresponding outputs of the plurality of signal paths.

12. The measurement circuit of claim 1, wherein:

the first node is a first input of the first signal path of the plurality of signal paths, wherein the first signal path of the plurality of signal paths comprises a first channel receive signal path;

the second node is a second input of the second signal path of the plurality of signal paths, wherein the second signal path of the plurality of signal paths comprises a second channel receive signal path; and the first semiconductor device is configured to receive the first signal over the selected signal path of the plurality of signal paths.

13. The measurement circuit of claim 12, further comprising:

a first passive coupler configured to couple the first test path to the first input; and a second passive coupler configured to couple the second test path to the second input.

14. The measurement circuit of claim 12, further comprising:

a power divider coupled to outputs of the plurality of signal paths; and a mixer having an input coupled to an output of the power divider.

15. A method of operating measurement circuit comprising a first semiconductor device, wherein the first semiconductor device comprises a plurality of signal paths each comprising a respective phase rotation circuit, a first node coupled to a first signal path of the plurality of signal paths, a second node coupled to a second signal path of the plurality of signal paths, and a common node coupled to the plurality of signal paths, wherein, the first node is configured to be coupled to a first antenna of a phased array antenna, the second node is configured to be coupled to a second antenna of the phased array antenna, and the method comprises:

providing a first signal at the common node having a first frequency;

providing a second signal to the first node over a first test path, the second signal having a second frequency different from the first frequency;

providing the second signal to the second node over a second test path;

transmitting over a selected signal path of the plurality of signal paths, one of the first signal and the second signal;

mixing the first signal with the second signal to obtain a measurement signal of the selected signal path, wherein a difference in phase delay between the second test path and the first test path comprises a first known phase delay;

obtaining stored phase information of a measurement signal of the first signal path; and measuring a phase difference between the first signal path and the selected signal path in accordance with the stored phase information, phase information of the measurement signal of the selected signal path, and the first known phase delay corresponding to the selected signal path from one of a plurality of known phase delays.

16. The measurement circuit of claim 1, wherein the phase measurement circuit is disposed on the first semiconductor device.

17. The measurement circuit of claim 1, wherein the phase measurement circuit is disposed on a second semiconductor device coupled to the first semiconductor device.

* * * * *